United States Patent [19]

Cochran

[11] 4,267,675

[45] May 19, 1981

[54] WELL WORKING RIG

[75] Inventor: Chudleigh B. Cochran, Houston, Tex.

[73] Assignee: Joe R. Brown, Houston, Tex.

[21] Appl. No.: 35,848

[22] Filed: May 4, 1979

[51] Int. Cl.[3] ..... B66C 23/06

[52] U.S. Cl. ..... 52/118; 212/267

[58] Field of Search ..... 52/117-121, 52/632, 645; 212/55

[56] References Cited

U.S. PATENT DOCUMENTS

| | | | |
|---|---|---|---|
| 2,993,570 | 7/1961 | Bender | 52/120 X |
| 3,016,992 | 1/1962 | Wilson | 52/117 X |
| 3,622,013 | 11/1971 | Swanson et al. | 52/121 X |

*Primary Examiner*—J. Karl Bell

*Attorney, Agent, or Firm*—Browning, Bushman & Zamecki

[57] ABSTRACT

Disclosed is a rig for working on wells, and including a generally two-legged mast, with each leg constructed with a traveling pole telescoping about and along a gin pole. The mast may be so extended by means of a chain drive mounted on the traveling legs of the mast. Hydraulically-operated slips selectively lock each traveling leg to the respective gin pole to prevent the former from sliding down the latter. The mast may be lowered to, and raised from, a generally horizontal configuration for transport on a truck. A snubber, or other pipe gripping apparatus, may be suspended by the mast and folded under the mast as the mast is moved to a horizontal configuration. With the mast erect, a control console may be elevated by means of a winch line supported by the mast. The mast may be mounted on a skid carried by a truck, with the skid movable relative to the truck bed for the purpose of aligning the mast relative to a well.

50 Claims, 36 Drawing Figures

FIG. 8
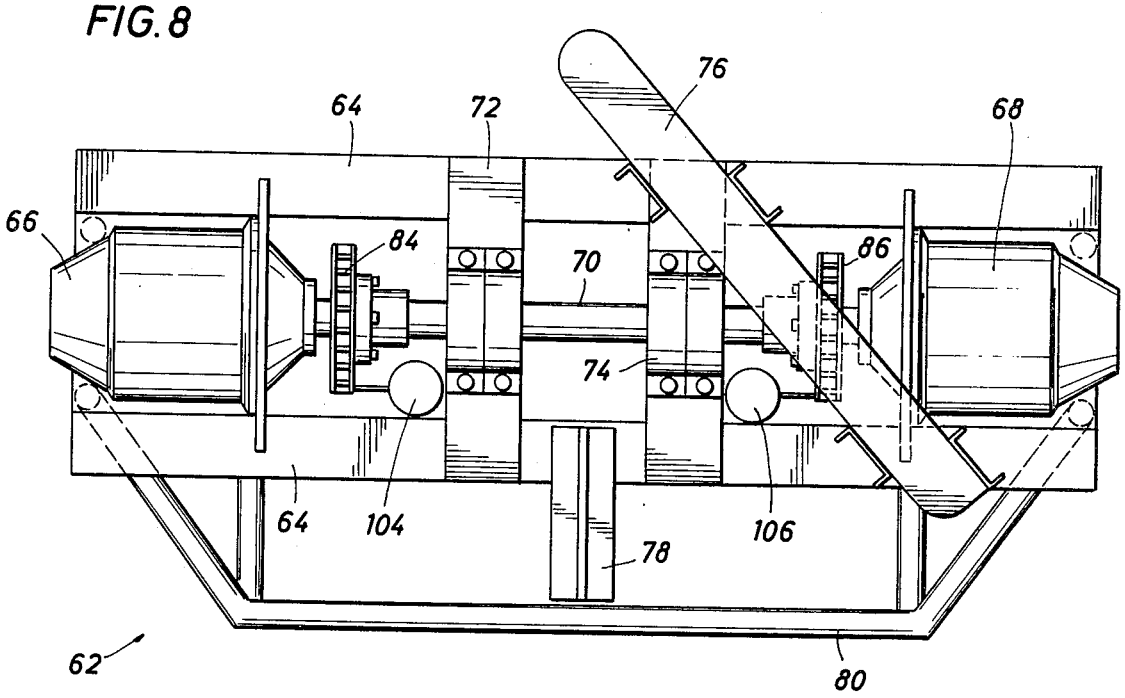
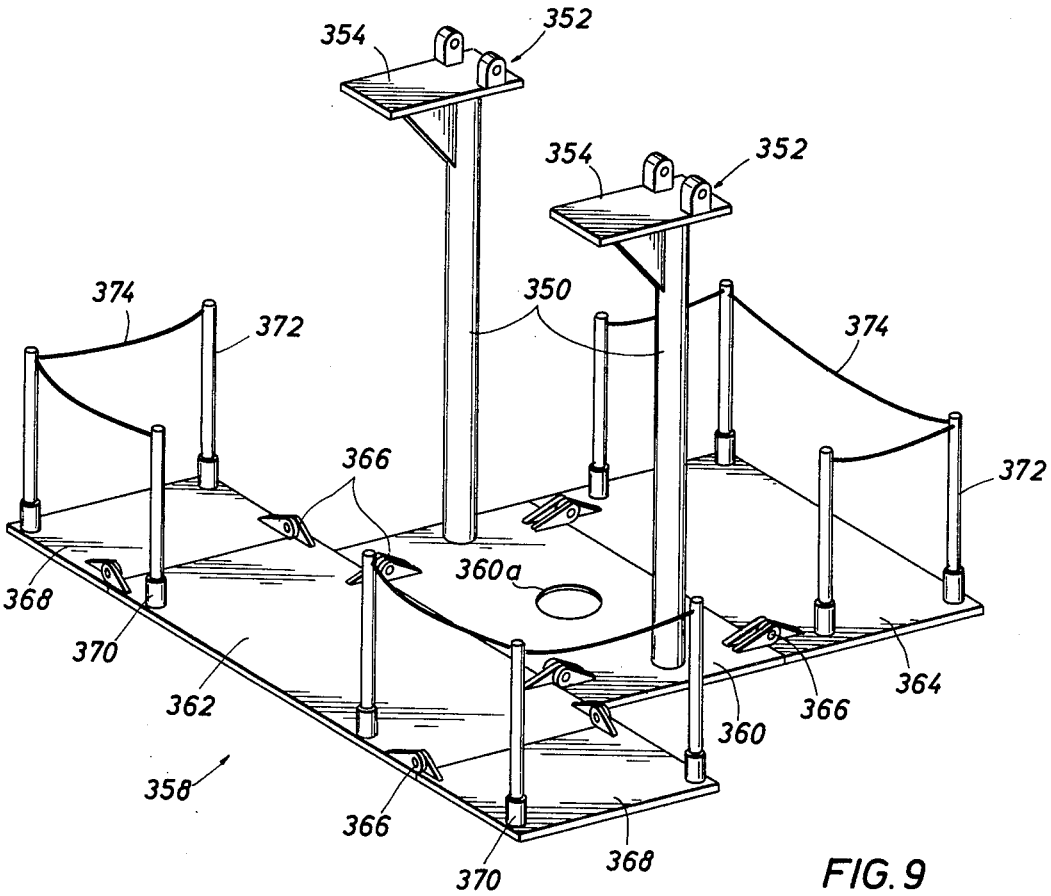
FIG. 9

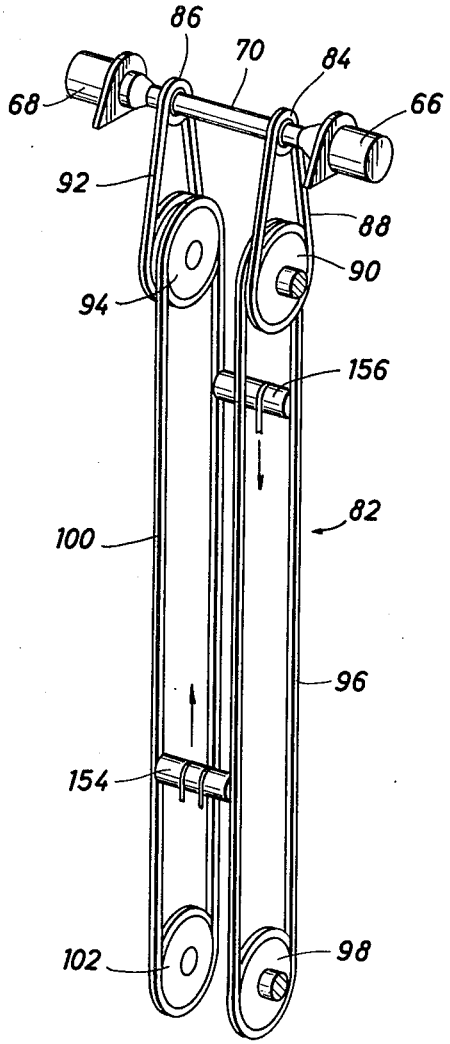
FIG. 10
FIG. 16
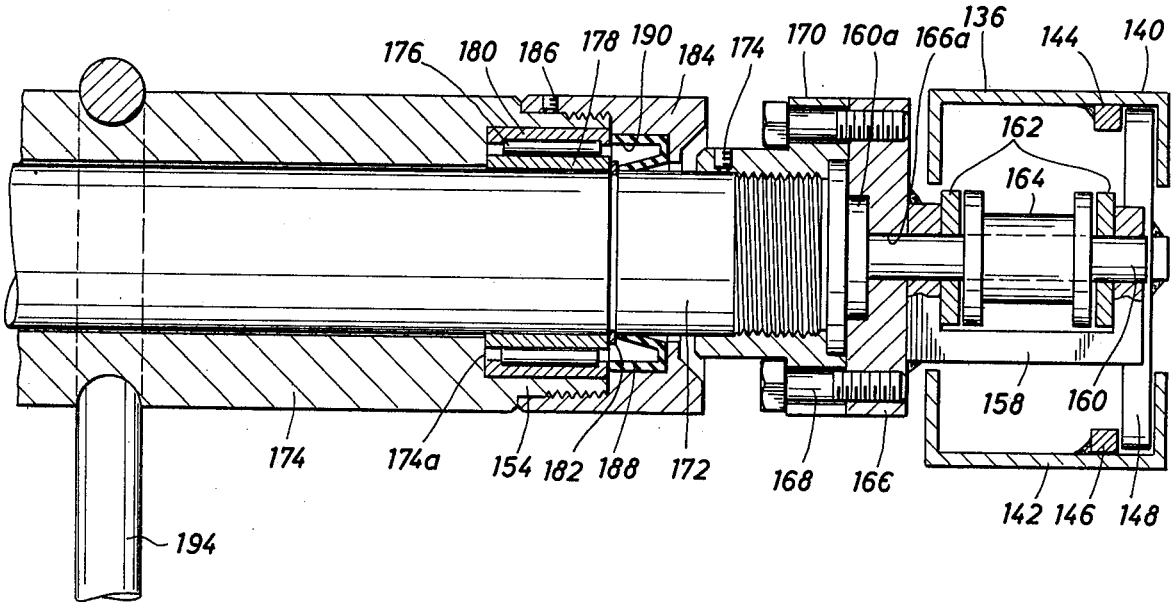

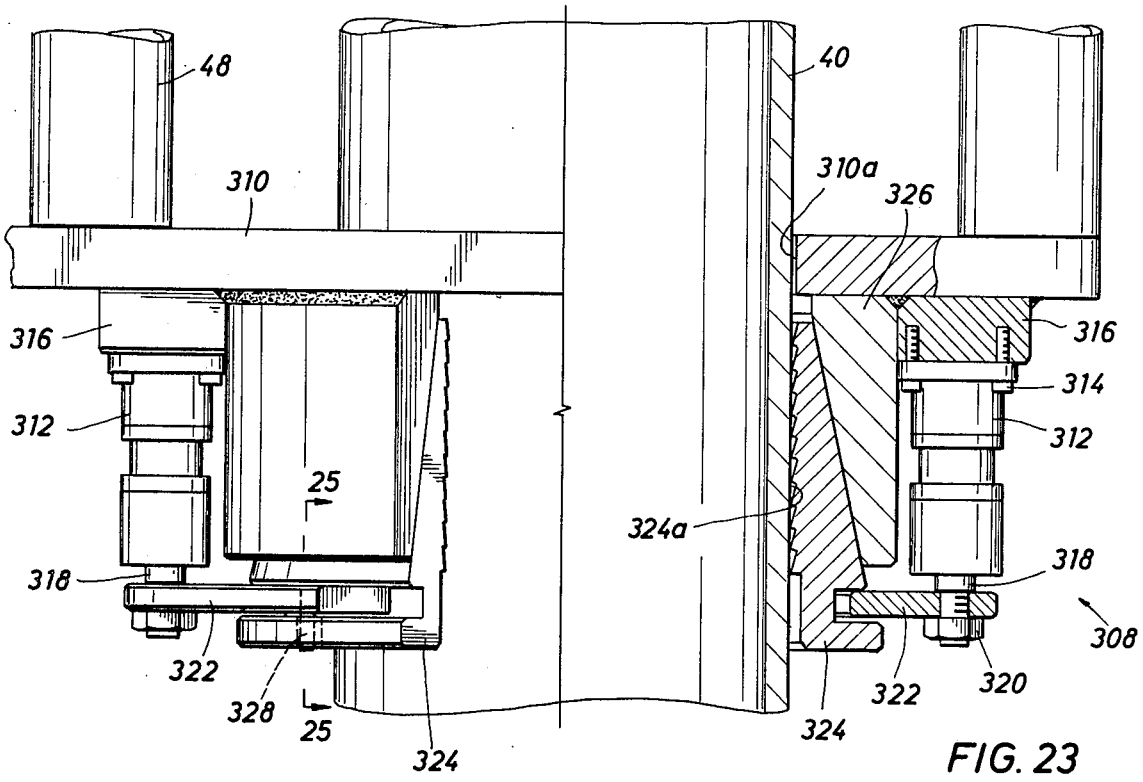
FIG. 23
FIG. 24
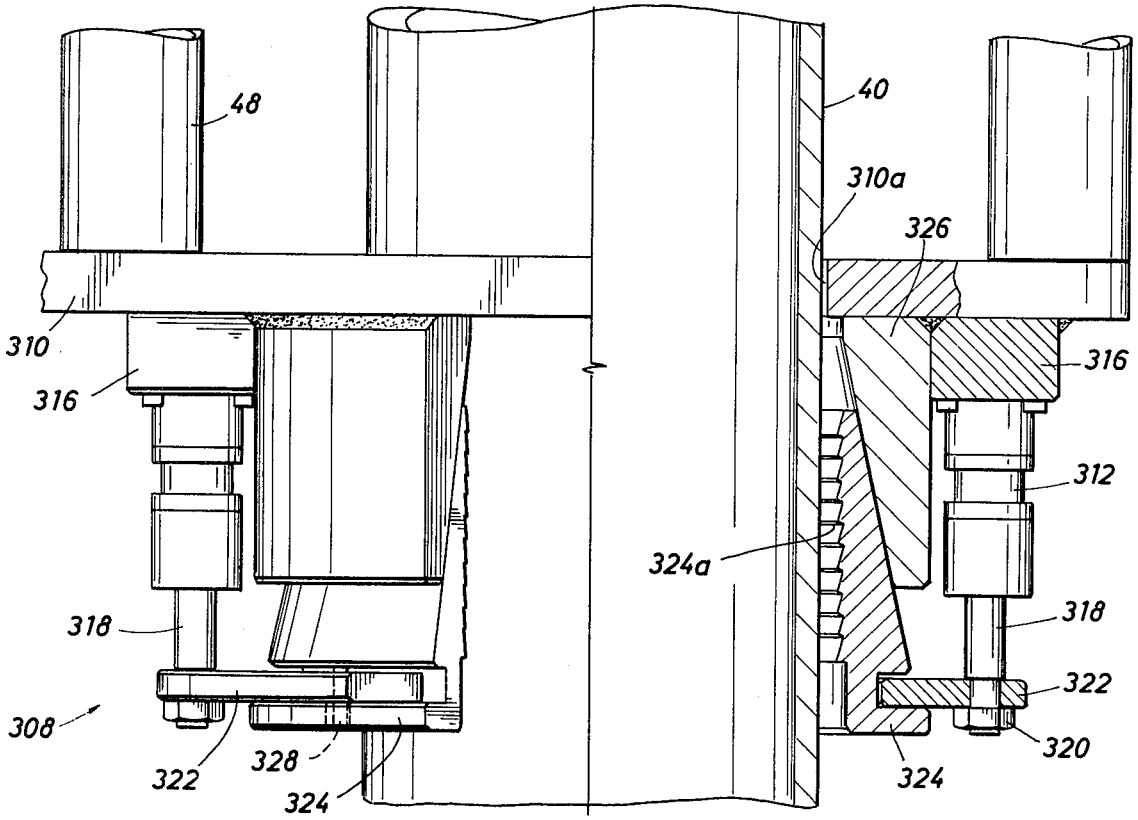

FIG. 26
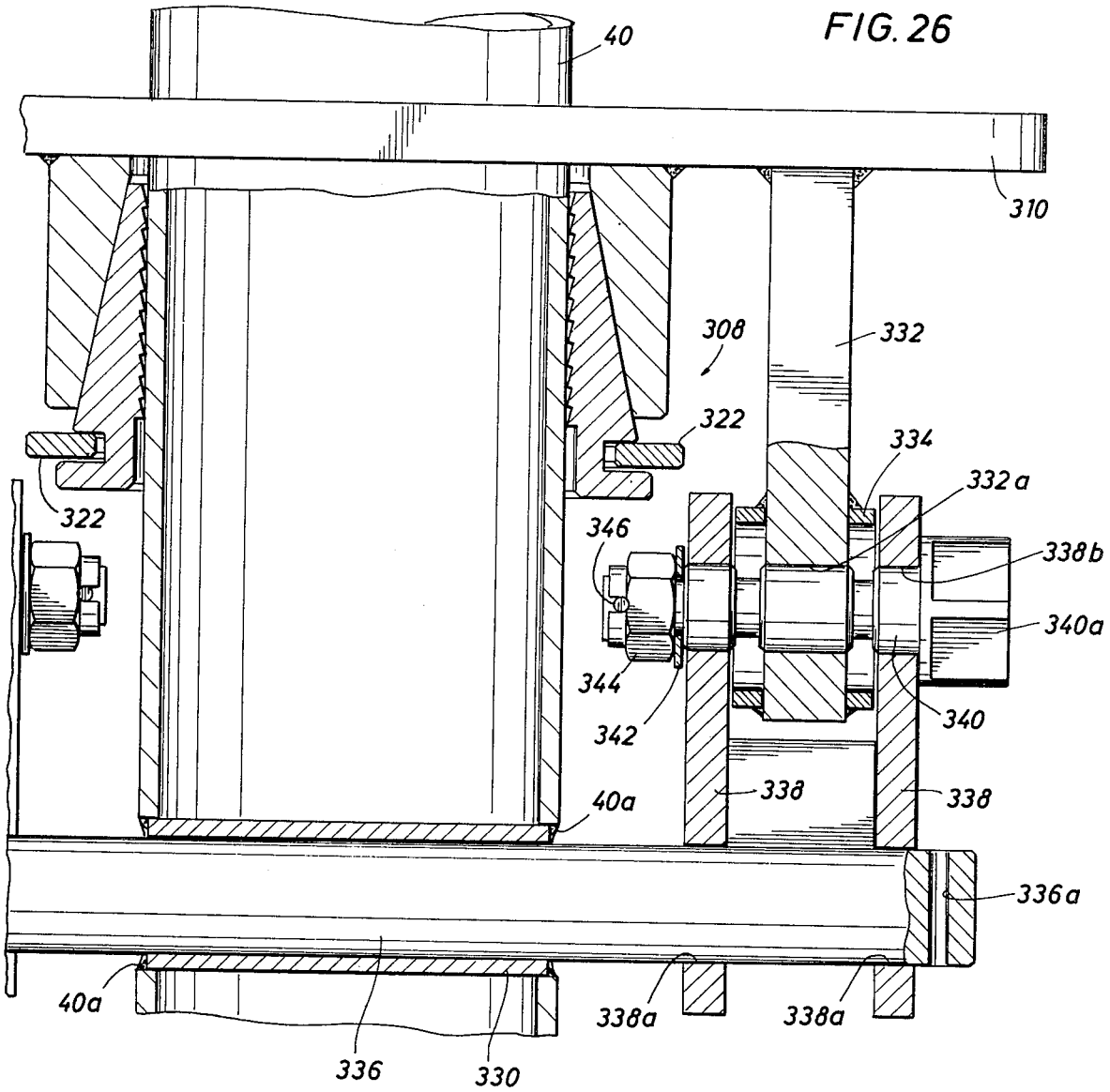
FIG. 25
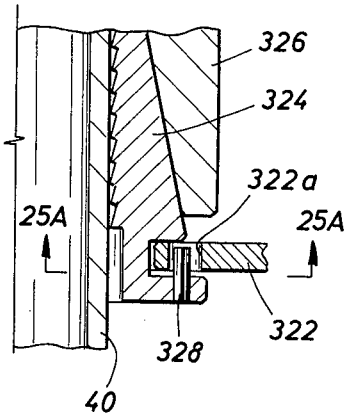
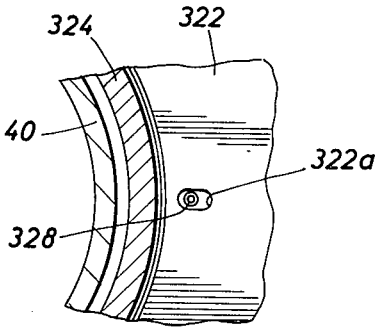
FIG. 25A

WELL WORKING RIG

BACKGROUND OF THE INVENTION

1. Field of the Invention

The present invention pertains to apparatus and methods for manipulating tubular members. More particularly, the present invention relates to well working apparatus for manipulating pipe members into and out of wells.

2. Description of Prior Art

Well working rigs of considerable variety are known, and include design features to achieve special purposes. For example, rigs are known with fold-down masts sufficiently lightweight to be transportable by truck to and from well sites. It is desireable, particularly for economic purposes, to be able to transport virtually an entire rig on a single truck, and to be able to configure the mast for operating on a well in a short period of time after arrival at the well site.

Workover rigs, for performing operations on already-drilled wells are generally small compared to rigs used to initially drill wells and may even take the form of a snubber, a gin pole and a winch line. Such workover rigs are generally transportable by truck. However, such workover rigs may be confined to manipulating a single pipe member at a time as opposed to a drilling rig which can typically manipulate a stand of three pipe members threaded together. Consequently, a workover rig should be operable to manipulate pipe members rapidly so as to minimize the time required to withdraw a pipe string from a well, or to insert a pipe string into a well.

Copending application for U.S. patent application Ser. No. 35,933, filed concurrently herewith, discloses apparatus and methods for manipulating two pipe members by means of two pipe handling devices carried by a Ferris-wheel type double chain assembly. The well working rig disclosed therein includes a foldable mast with motors, for driving the chain, mounted on the masthead.

SUMMARY OF THE INVENTION

The present invention provides apparatus and methods for manipulating pipe members. A two-legged mast is constructed with each leg divided into a lower, gin pole and an upper traveling leg, or pole. In each case, the traveling pole telescopes about and along the corresponding gin pole. With the two traveling poles joined together, the mast is extendable and retractable by movement of the traveling poles relative to the gin poles.

The mast may be so extended by means of a chain drive, including, say, a hoisting bar, and mounted on the traveling legs of the mast. The dual continuous working chain assembly of the aforementioned U.S. patent application Ser. No. 35,933, for example, may be utilized for this purpose. The dual chain assembly includes a pair of chains extended in generally oblong, or elongate, loops along the traveling poles. The chains are joined together by one or more hoisting bars. A sprocket wheel assembly, mounted on the traveling poles, operates to rotate the chains, in unison, in one rotational sense or the other.

The present invention includes a hoisting mechanism framework, mounted on the gin poles, and featuring one or more hoisting clamps. The hoisting clamps are hydraulically operable to extend to a configuration in which the clamps receive a hoisting bar as the chain drive is operated to move the hoisting bar, and to retract to a configuration in which the clamps do not engage a passing hoisting bar. With the clamps engaging a hoisting bar, the chain drive may be operated to lower the hoisting bar, so engaged, relative to the traveling poles. With the hoisting bar held fixed relative to the gin poles, the traveling legs will be lifted, by the chain drive, relative to the gin poles. Operation of the chain drive to raise the hoisting bar, so engaged, relative to the traveling poles may be carried out to lower the traveling poles relative to the gin poles. The clamps may be disengaged from the hoisting bar, and retracted, when the desired position of the traveling poles relative to the gin poles is achieved.

To accomodate the attachment of the hoisting mechanism framework on the gin poles and still allow telescopic movement of the traveling poles along and about the gin poles, the traveling poles are constructed with an elongate slot, or split, along one side, corresponding to the side of the gin poles wherein the hoisting mechanism framework is mounted.

The extendable mast may be locked into position against retraction by a slip cone assembly attached to the traveling poles. The slip cone assembly is hydraulically operable to move a plurality of slips between a release configuration and an anchoring configuration in which the slips engage the gin poles to prevent downward movement of the traveling poles along the gin poles.

The mast, which is foldable, also supports a snubber and/or other pipe handling devices, connected to the traveling poles by a hinged connection. As the erect mast is retracted, the snubber, for example, is pivoted to partially fold. Then, as the retracted mast is pivoted toward the same direction as the snubber and toward a generally horizontal orientation, the snubber is further pivoted. Thus, for example, the snubber may be folded under the mast. As the mast is raised and then extended, the snubber unfolds relative to the mast and may be oriented with its longitudinal axis generally parallel that of the mast.

A control console assembly by which the mast and related equipment may be operated, or other platform, may be elevated along generally vertical supports by means of one or more winch lines extending from the control console assembly, for example, to an elevated position along the mast, and then to a winch mechanism.

The mast may be mounted on a skid, or similar platform, supported on a base, such as a flatbed truck. A double fluid cylinder assembly cooperates with a pin-in-slot system to provide a position adjustment of the skid relative to the base along one direction, say the longitudinal dimension of the flatbed. Outriggers are coupled to the flatbed, at least in part, by fluid cylinder assemblies. With one end of the flatbed truck supported by the outriggers, operation of such fluid cylinder assemblies shifts that end of the flatbed laterally. Consequently, the skid supporting the mast may be made to move laterally in one direction by means of the skid being moved relative to its base, and along a direction generally perpendicular to the first direction by means of the base being shifted on its supporting outriggers.

The present invention thus provides a relatively rapid technique for operating on a well, and particularly provides apparatus and methods whereby a well working rig may be rapidly, efficiently and conveniently moved between an operating configuration and a configuration wherein the rig may, for example, be transportable on a flatbed truck.

BRIEF DESCRIPTION OF THE DRAWINGS

FIG. 8 is a top plan view of the rig mast in vertical orientation, showing the twin motors, taken along line 8—8 of FIG. 4;

FIG. 9 is a perspective view of the work basket in unfolded configuration.

FIG. 10 is a schematic perspective view of the chain and sprocket wheel assembly of the rig;

FIG. 16 is a partial plan view, in partial section, of a hoisting bar showing the connection of the hoisting bar to one of the working chains;

FIG. 23 is a fragmentary side elevation, in partial section, of one mast pole and the corresponding slip cone assembly, taken along line 23—23 of FIG. 22, showing the slip cones in anchoring configuration;

FIG. 24 is a view similar to FIG. 23, but showing the slip cones in release configuration;

FIG. 25 is a fragmentary side elevation, in partial section, showing the linkage of a slip cone, taken along line 25—25 of FIG. 23;

FIG. 25A is a bottom plan view of the fragment of FIG. 25, taken along line 25A—25A of FIG. 25;

FIG. 26 is a fragmentary view similar to FIG. 23, but showing the locking of a traveling pole to a gin pole.

DESCRIPTION OF PREFERRED EMBODIMENTS

The present invention is included in apparatus for manipulating pipe members shown in FIGS. 1–34 as a chain operated, Ferris wheel type well working rig mounted on a truck bed. The well working rig is shown at 10 in FIGS. 1–7, with details shown in FIGS. 8–26. The manner of operation of the well working rig 10 is illustrated FIGS. 27–29. Details of the adjustable mounting of the rig skid on the truck bed are provided in FIGS. 30–33. A hydraulic system for operating the rig is shown schematically in FIG. 34.

Figure 1:
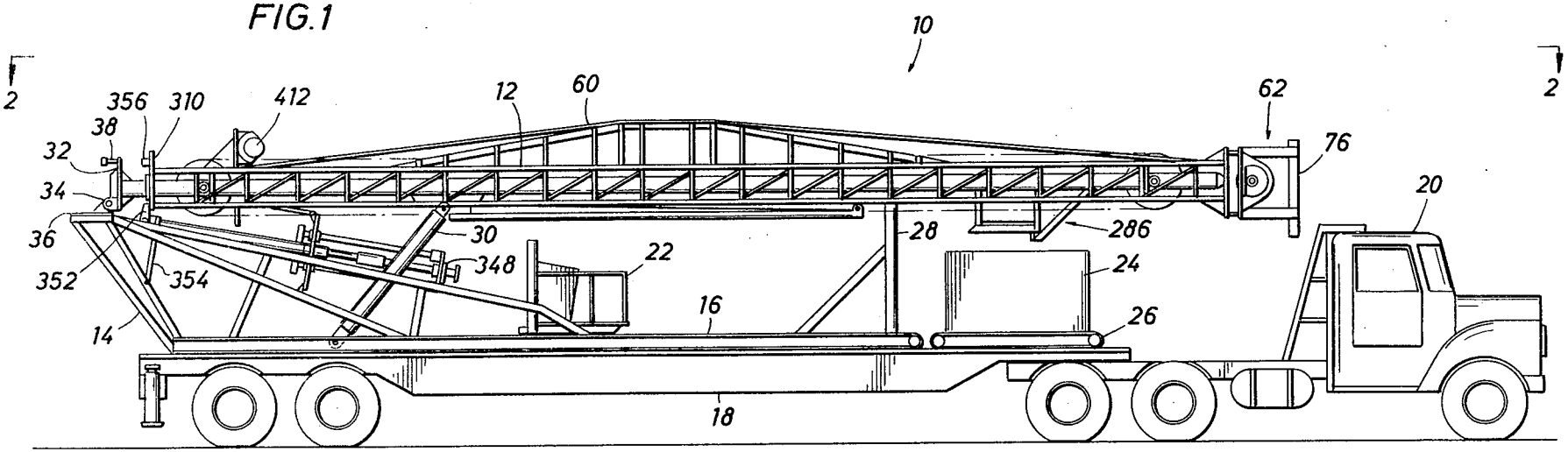
FIG. 1 is a side elevation of a chain drive, Ferris-wheel type well working rig mounted on a truck bed and in collapsed and folded configuration.
Figure 2:
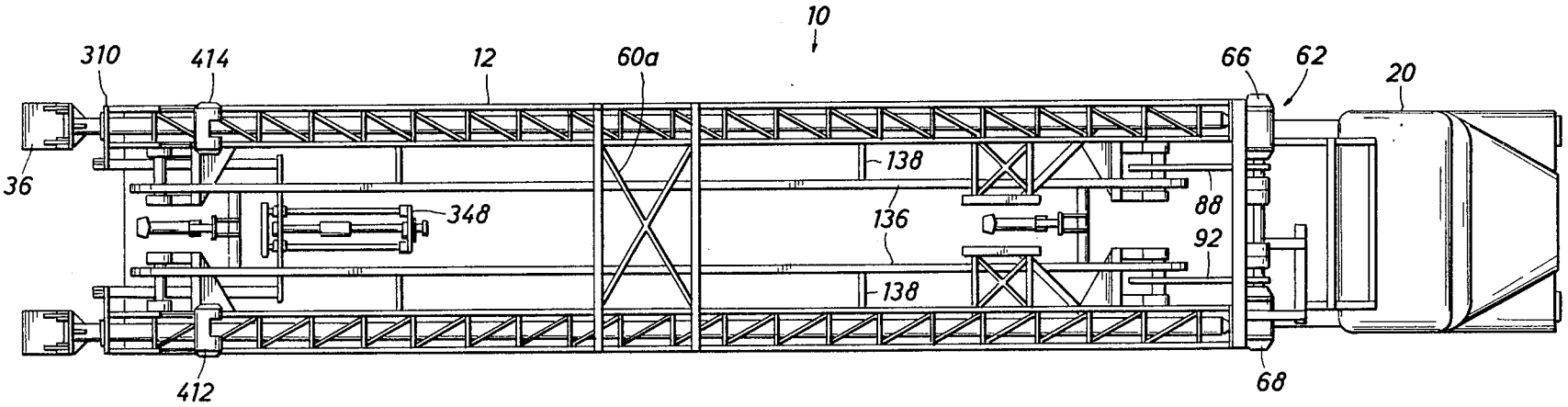
FIG. 2 is a top plan view of the well working rig as shown in FIG. 1, taken along line 2—2 of FIG. 1.

The well working rig 10 includes a mast 12 mounted, by means of a substructure frame 14 on a skid 16. The skid 16 is supported on a flatbed 18 propelled by a fifth-wheel type truck 20. In FIGS. 1 and 2 the mast is shown in a collapsed and folded configuration, extending forward over the flatbed 18. A control console assembly 22 is also supported by the skid 16 (FIG. 1). A power assembly 24 is mounted on a separate skid 26 which is supported by the forward end of the flat bed 18.

Figure 3:
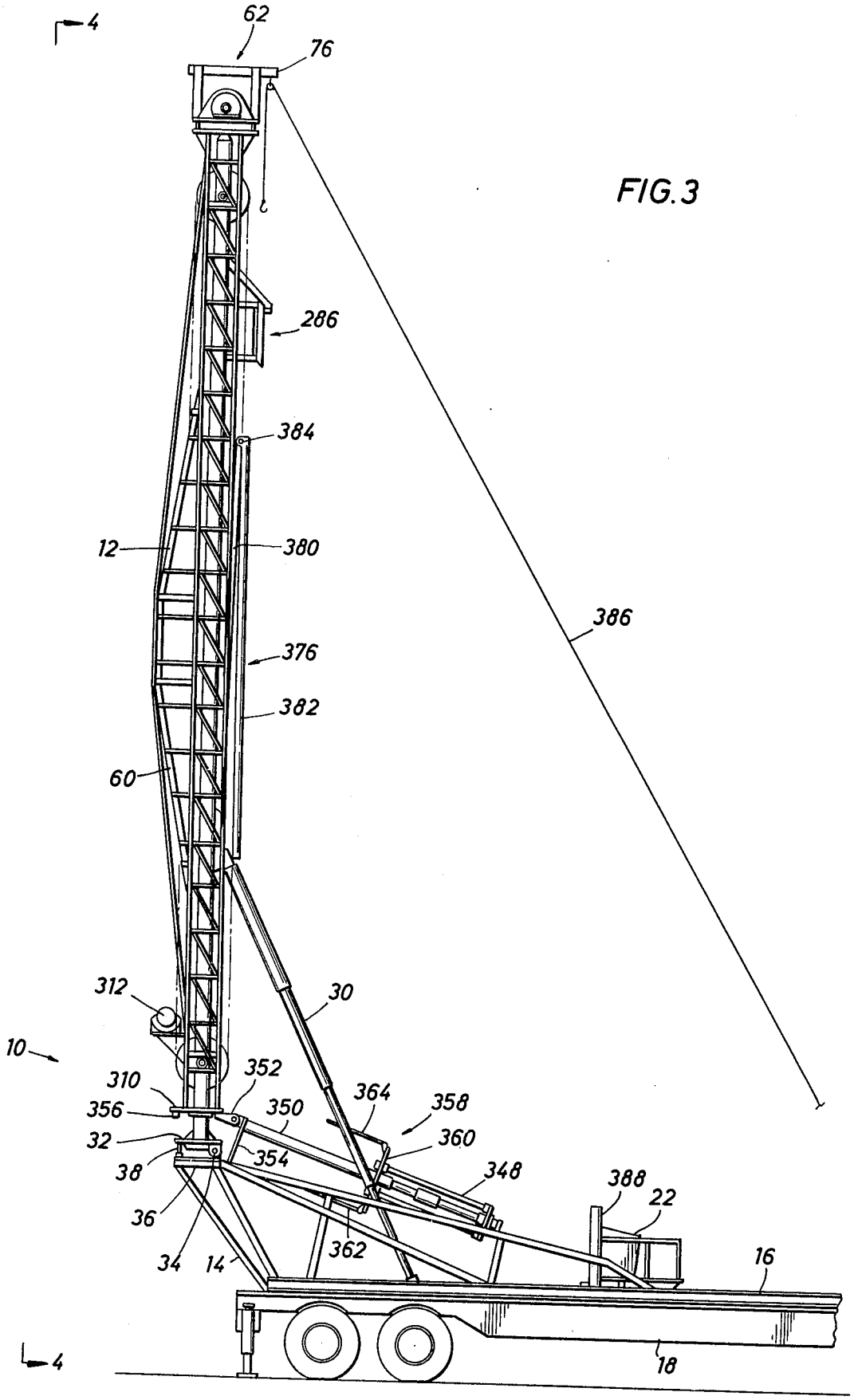
FIG. 3 is a partial side elevation of the rig of FIGS. 1 and 2, showing the mast erect.
Figure 4:
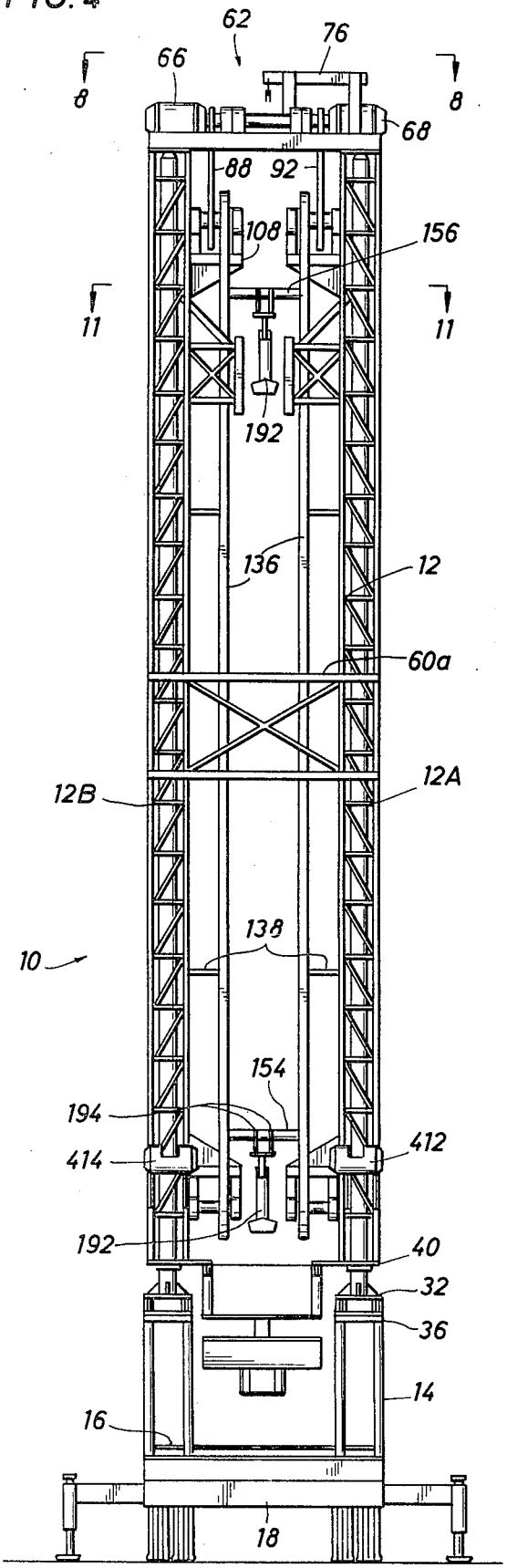
FIG. 4 is an end elevation of the vertical mast, taken along line 4—4 of FIG. 3.

As seen in FIG. 1 the substructure framework 14 extends beyond the back end of the skid 16. In the collapsed and folded configuration, the mast 12 also rests on a support framework 28 positioned on the forward portion of the skid 16.

in FIGS. 3 and 4 the mast 12 is shown in an erect, collapsed configuration. The mast 12 is erected by operation of a pair of three stage piston-and-cylinder assemblies 30 which are hingedly connected to both the skid 16 and the mast 12. The bottom of the mast 12 includes a pair of feet 32 which are pivotedly connected by hinge pins 34 to a pair of flat plates 36 forming the top of the substructure framework 14. Adjustable pins 38 extend from the feet 32 to form support points in contact with the flat plates 36 when the mast is in the erect configuration, in addition to the hinge pin connections 34. Swing bolts (not shown) may be used to latch the feet 32 to the flat plates 36 when these elements 32 and 36 are closed upon each other in the mast-erect configuration. The mast 12 is then locked in the erect configuration.

Figure 7:
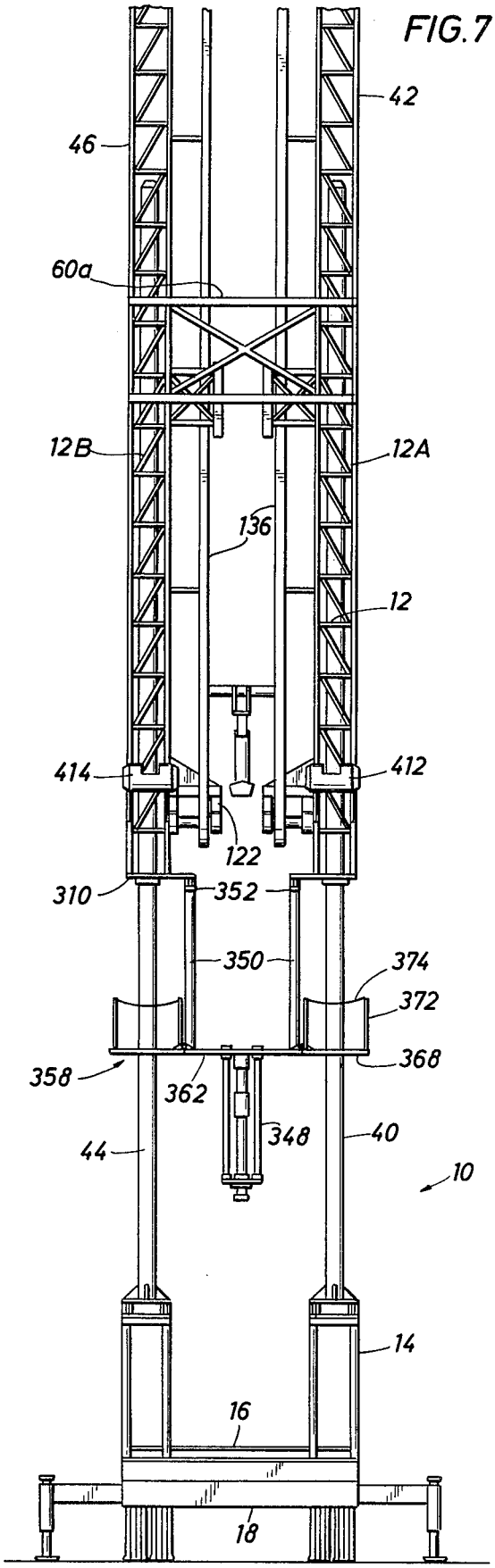
FIG. 7 is an end elevation of the rig mast extended in vertical configuration, taken along line 7—7 of FIG. 6.
Figure 5:
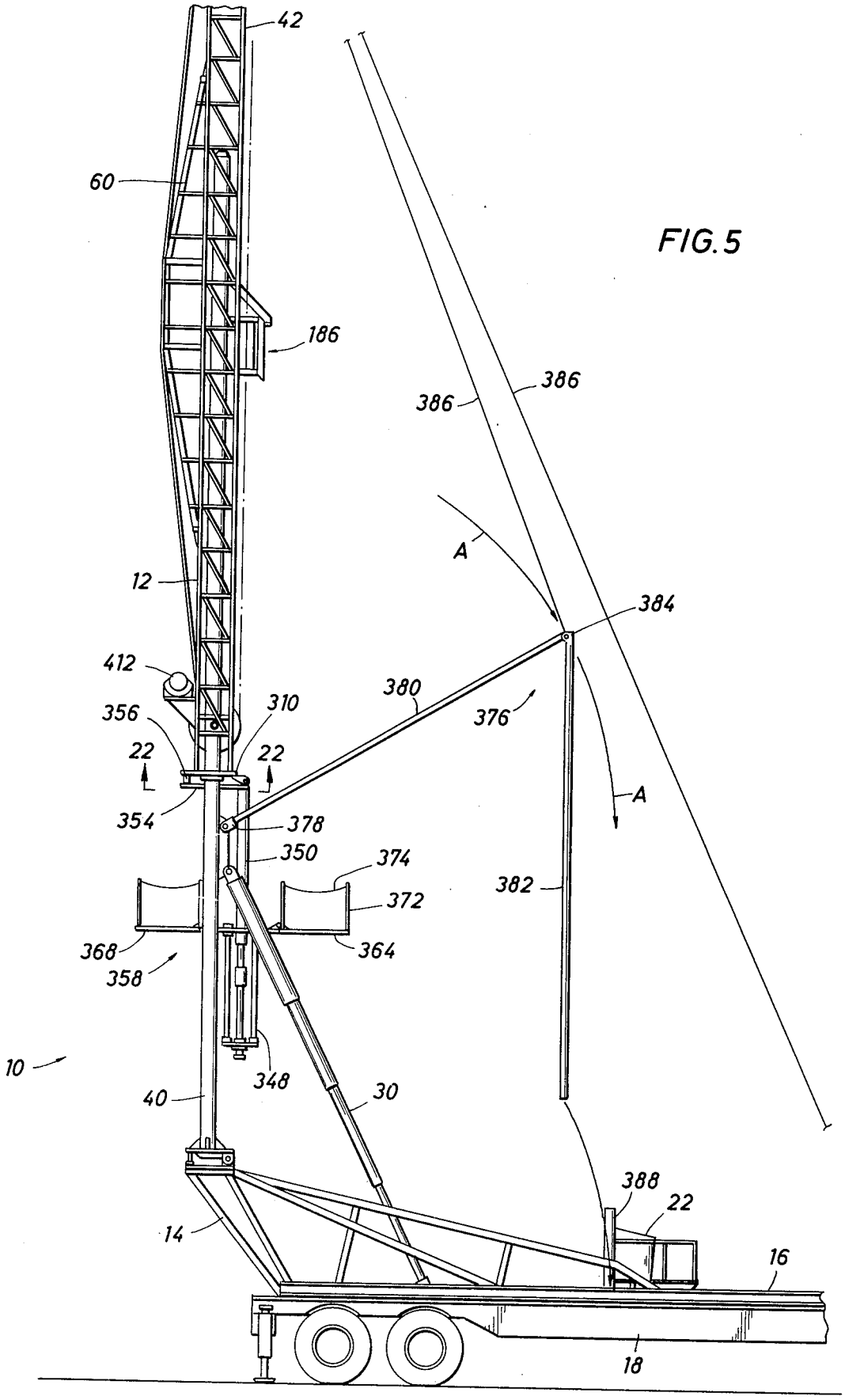
FIG. 5 is a partial side elevation of the rig mast extended in vertical configuration, with the work basket unfolded, the control console legs partially lowered, and the snubber in vertical orientation.
Figure 6:
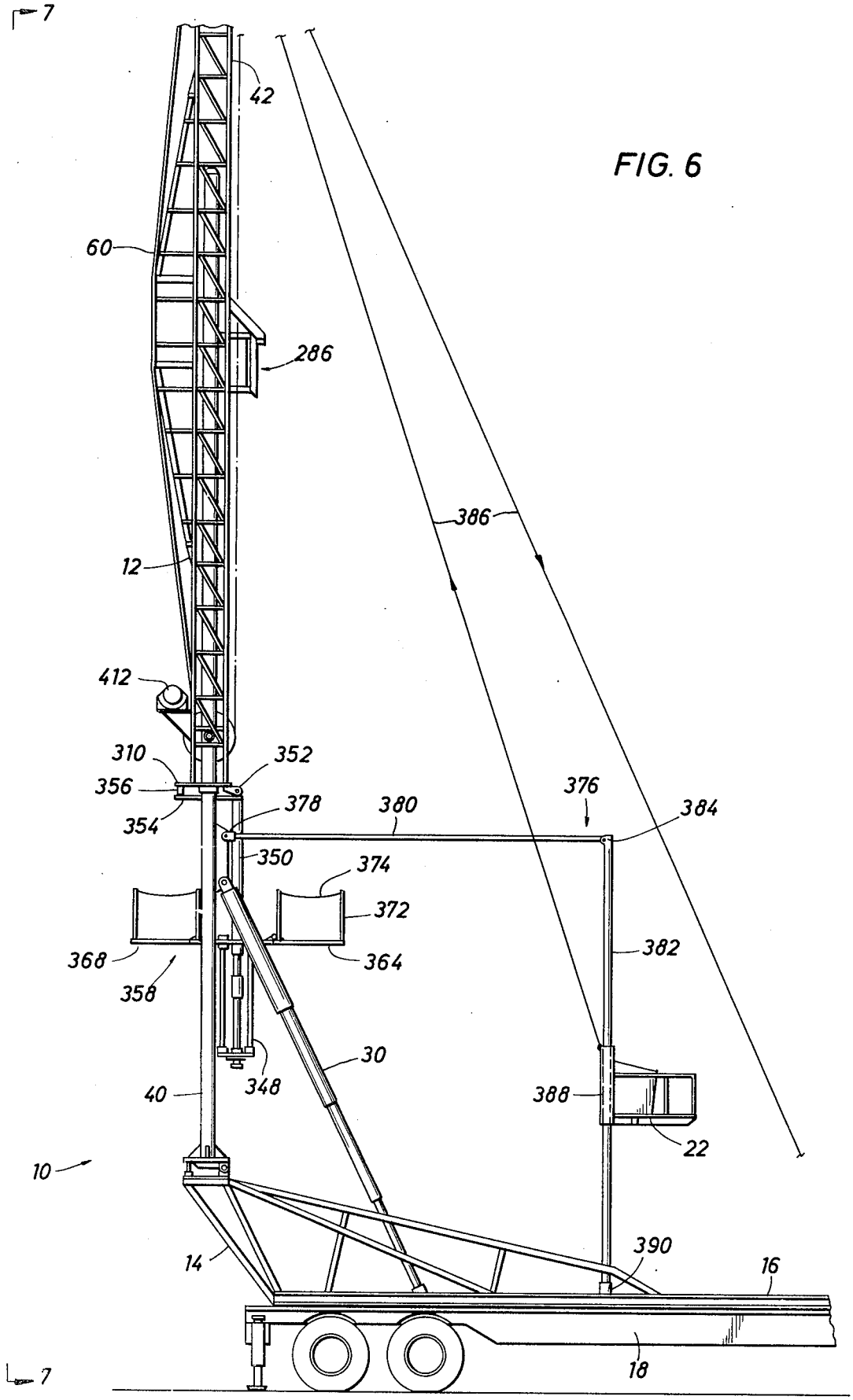
FIG. 6 is a view similar to FIG. 5, but showing the control console raised on the lowered control console legs.

The mast 12 may be extended upwardly as shown in FIGS. 5–7. The manner of extending the mast is discussed in detail hereinafter. As may be appreciated by reference to FIGS. 3–7, the mast 12 includes generally two legs **12*a* and 12*b*, each such leg being constructed in two sections. Thus, the leg 12*a* includes a gin pole 40 and a traveling pole 42. The leg 12*b* includes a gin pole 44 and a traveling pole 46. Each of the gin poles 40 and 44 are generally elongate cylindrical members having at their lower ends the feet 32. Each of the traveling legs 42 and 46 feature generally four elongate tubular members fastened together with a network of cross pieces and struts. Construction of the traveling poles may be further appreciated by reference to FIG. 11. The traveling pole 42 includes the four hollow elongate members 48 joined by cross pieces 50. Similarly, the traveling pole 46 includes four hollow elongate members 52 joined together by cross pieces 54**.

A plurality of centering plates 56 are positioned generally throughout the length of the traveling leg 42, with each centering plate joined to each of the tubular members 48. Each centering plate 56 includes an arcuate opening 56A generally concentric with the periphery of the plate, and a generally V-shaped passage **56*b* leading to the opening 56*a*. The arcuate opening 56*a* in each plate 56 is sufficiently large to receive the elongate gin pole 40. However, the passage 56*b* is sufficiently narrow at the intersection with the arcuate opening 56*a* to confine the gin pole 40 within the arcuate opening. A similar plurality of centering plates 58 are likewise positioned along the length of the traveling pole 46, joined to the tubular members 52. An arcuate opening 58*a* receives the gin pole 44. A V-shaped passage 58*b* of design similar to 56*b* also leads to the arcuate hole 58*a* in each plate 58**.

Each of the traveling poles 42 and 46 is thus composed of a framework of tubular members, centering plates, and cross pieces and struts. A truss assembly 60 adds rigid support to the back of both traveling poles 42 and 46, and includes cross members **60*a* (FIGS. 2, 4 and 7**) whereby the traveling poles are interconnected.

The traveling poles 42 and 46 are also interconnected at their respective top ends by a masthead assembly shown generally at 62, and illustrated in detail in FIG. 8. The masthead assembly 62 includes cross members 64 linking the ends of the two traveling poles 42 and 46. Two motors 66 and 68 are mounted on the cross members 64 with their respective drive shafts aligned generally along the same axis transverse to the traveling poles 42 and 46. A coupling shaft 70 connects the drive shafts of the two motors 66 and 68, and is constrained within brackets 72 and 74 connected to the cross members 64. The coupling shaft 70 rides within suitable bearings contained within the brackets 72 and 74.

A pulley support frame 76 extends generally across the masthead assembly 62 and provides support points, extending beyond the cross members 64, for pulleys utilized with winch lines, as described hereinafter. A second pulley support 78 (FIG. 8) extends outwardly from the cross member 64 at the back of the masthead 62. A protective bumper 80 (FIG. 8) may be constructed to extend outwardly beyond the rearward cross member 64 to protect the masthead assembly, particularly during transit.

The motors 66 and 68 are utilized to operate a double-chain Ferris wheel type drive assembly, shown schematically at 82 in FIG. 10. A pair of sprocket wheels 84 and 86 are carried by, and held fixed against rotational motion relative to, the motor drive shafts and the coupling shaft 70. A continuous drive chain 88 engages the sprocket wheel 84 and also engages a double-rim, or double wheel, sprocket driver 90. A similar drive chain 92 links the sprocket 86 with a double-rim drive sprocket wheel 94. A continuous working chain 96 engages the inner rim sprocket of the driver 90 and extends downwardly to engage a sprocket wheel 98. Similarly, a continuous working chain 100 engages the sprockets of the second, or inner rim of the driver 94 and extends downwardly to engage a sprocket wheel 102. Operation of the two motors 66 and 68, which motors may be hydraulically operable, is synchronized. Thus, both motors may be operated off of the same power source and through the same hydraulic feed lines. Thus, virtually zero speed differential may be maintained between the two motore 66 and 68. Consequently, operation of the chain and sprocket wheel assembly 82 is carried out with the sprocket wheels 84 and 86 rotating in unison. Therefore, drivers 90 and 94 rotate in unison, and wheels 98 and 102 are rotated in unison. Consequently, the working chains 96 and 100 are pulled, by means of the drivers 90 and 94, respectively, about the wheels 98 and 100 in the same rotational sense and at the same rotational rate. Therefore, for any given point in the working chain 96 moving along the continuous path defined by the configuration of the chain 96, there is a corresponding point on the working chain 100, moving at any moment in a path paralleling that of the first point on the working chain 96, and in the same direction and at the same rate. The sprocket wheels 84 and 86, and the drive chains 88 and 92, are maintained in a lubricated state by means of gravity feed oilers 104 and 106, respectively, mounted on the masthead assembly 62 (FIG. 8).

Figure 11:
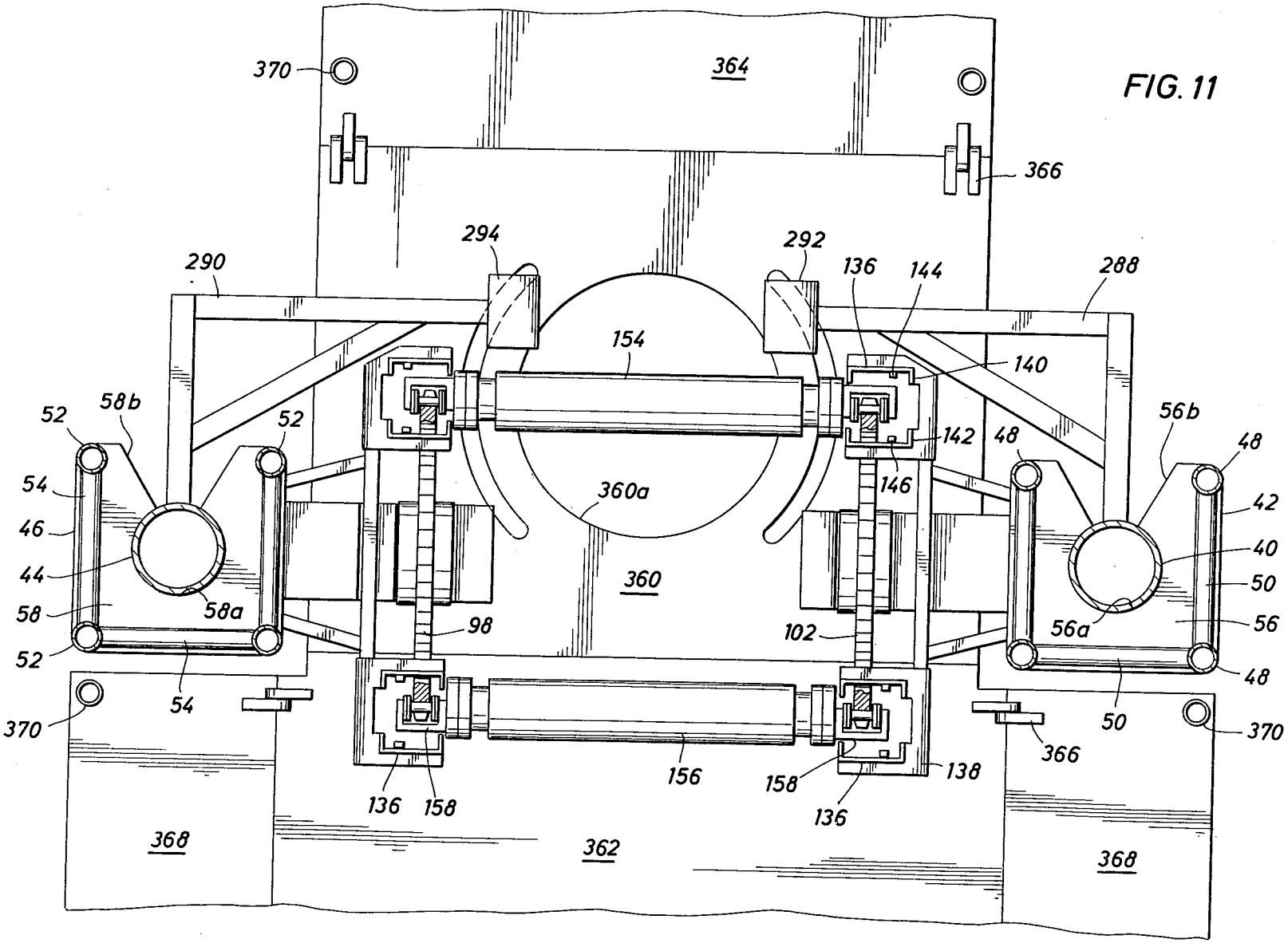
FIG. 11 is a horizontal cross section of the mast in vertical orientation, taken along line 11—11 of FIG. 4, showing the mast pole construction.
Figure 13:
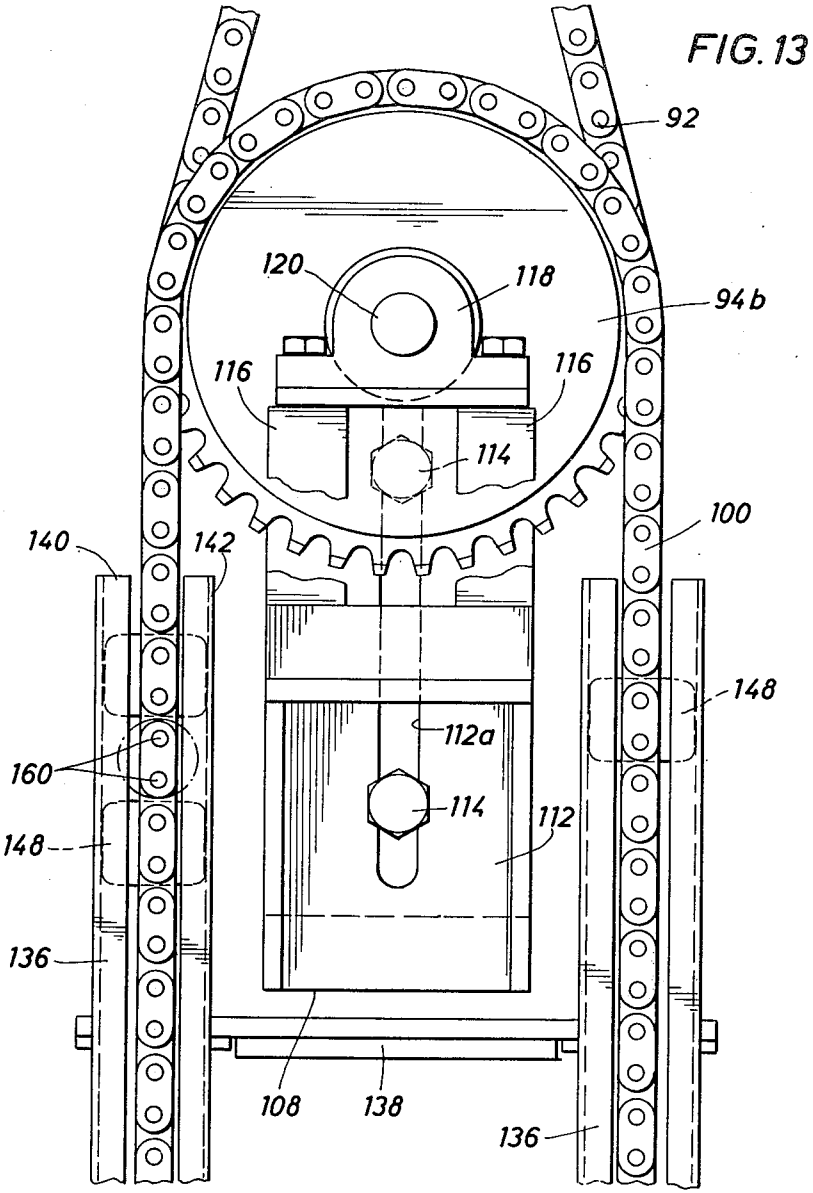
FIG. 13 is a side elevation of the upper drive wheel assembly of FIG. 12, taken along line 13—13 of FIG. 12.
Figure 12:
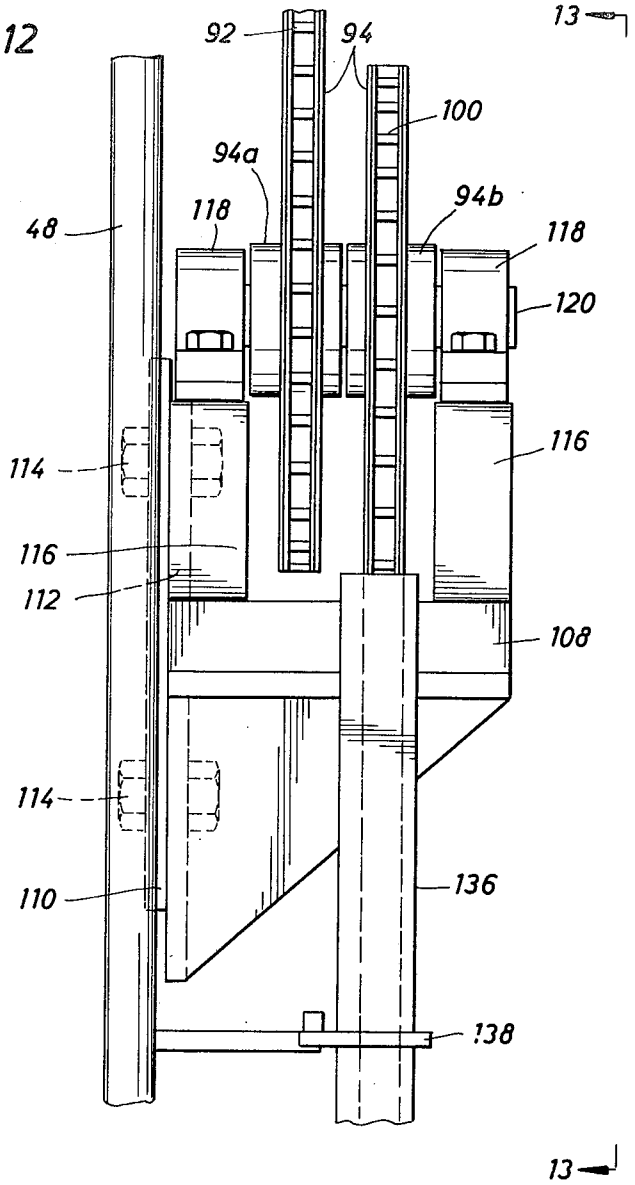
FIG. 12 is a fragmentary end elevation of one of the upper drive wheel assemblies.

The construction and operation of the double-rimmed sprocket drivers may be appreciated by reference to FIGS. 12 and 13, which show details of the construction and mounting of one of the sprocket drivers, say 94, the remaining sprocket driver 90 being virtually the same in its construction and mounting. A mounting bracket 108 is bolted to a mounting plate 110 fixed to the structure of the traveling pole 42. In FIG. 12, the traveling leg 42 is indicated by the illustration of a fragment of one of its elongate tubular members 48. The mounting plate 110 may be welded to such tubular members 48, and/or to cross members 50 (FIG. 11).

The bracket 108 includes a back plate 112 containing an elongate slot therethrough **112*a*. A pair of nut and bolt combinations 114 passes through the slot 112*a* and corresponding throughbores in the mounting plate 110. Tightening the nut and bolt combinations 114 maintains the mounting bracket 108 fixed against movement relative to the mounting plate 110 and, therefore, the traveling pole 42**.

The mounting bracket 108 includes two pairs of upwardly-directed posts 116. A bearing-lined bracket 118 is fixed to the top of each pair of posts. The sprocket driver 94 is positioned on a shaft assembly 120 which rides within the bearing brackets 118.

As may be seen in FIG. 12, the sprocket driver 94 may be constructed fom a pair of individual sprocket wheels 94*a* and 94*b*. The sprocket wheels 94*a* and 94*b* are mounted on the same shaft assembly 120, and are therefore constrained to rotate in unison.

With the drive chain 92 in place about the sprocket wheel 86 and the sprocket driver wheel 94*a*, the mounting bracket 108 may be adjusted vertically, with the nut and bolt combinations 114 loosened, to provide the proper amount of tension in the drive chain 92. The slot 112*a* accomodates vertical movement of the mounting bracket for this purpose. With the bracket 108 properly positioned with the appropriate amount of tension in the drive chain 92, the working chain 100 may be positioned about the driver sprocket wheel 94*b*.

Figure 15:
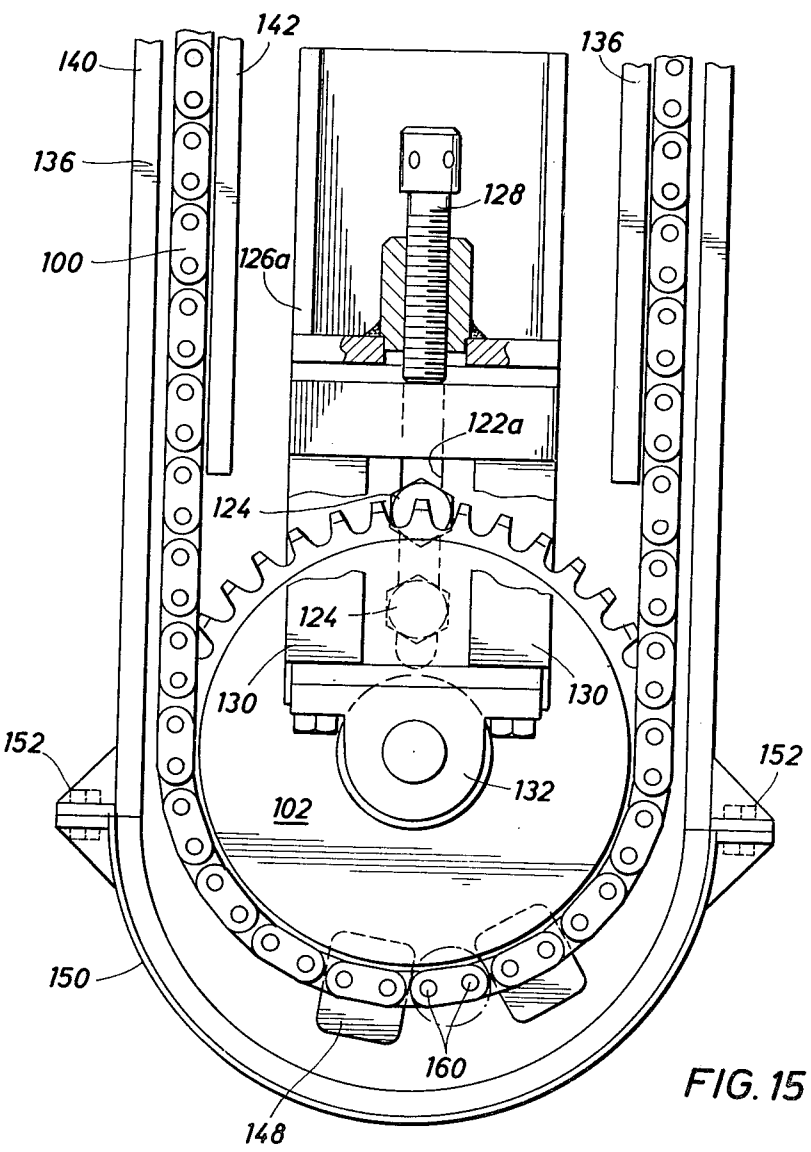
FIG. 15 is a side elevation of the lower sprocket wheel assembly of FIG. 14, taken along line 15—15 of FIG. 14.
Figure 14:
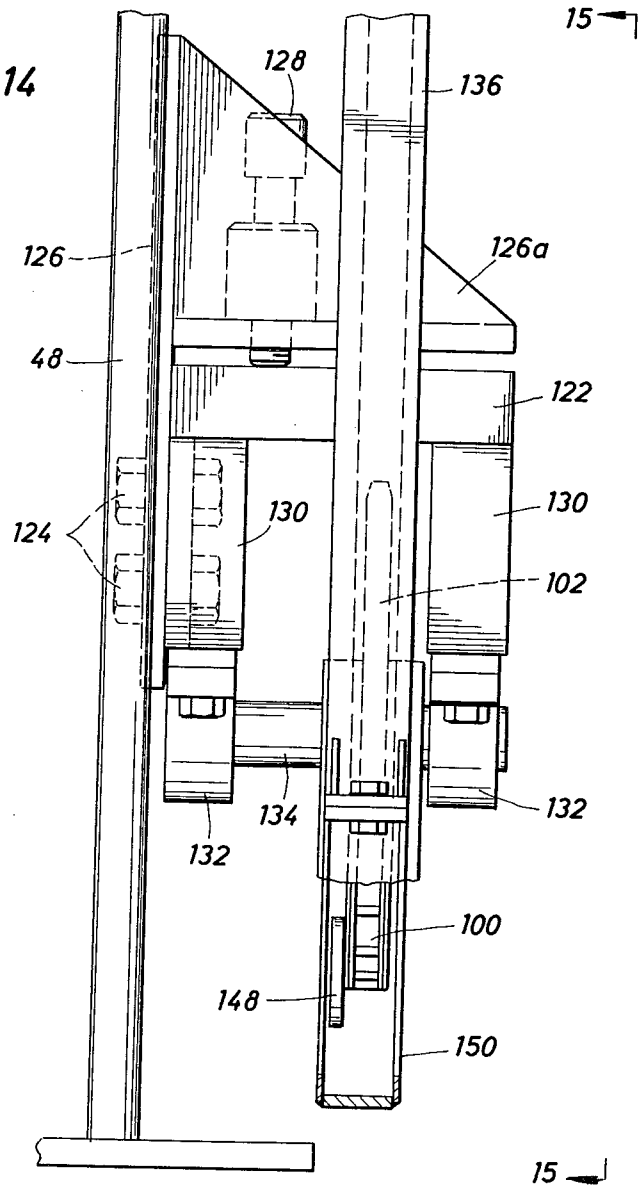
FIG. 14 is a fragmentary end elevation of one of the lower sprocket wheel assemblies.

Details of the lower sprocket wheel 102 mounting may be appreciated by references to FIGS. 14 and 15, it being noted that a similar construction and mounting is provided for the sprocket wheel 98. A mounting bracket 122 features a vertical slot 122*a* by which the mounting bracket is held, with nut and bolt combinations 124, to a mounting plate 126 fixed relative to the traveling pole 42, here indicated by a vertical tubular member 48 (FIG. 14). The verticl position of the mounting bracket 122 may thus be adjusted, in the manner of adjustment of the upper mounting bracket 108, to provide the proper tensioning of the working chain 100. With the bracket 122 thus positioned, the nut and bolt combinations 124 may be tightened to hold the mounting bracket fixed relative to the traveling pole 42. Additional constraint is placed on the bracket 122 by a bolt 128 threadedly engaged in an overhang 126A of the mounting plate 126. The bolt 128 is so positioned to lock the mounting bracket 122 from upward movement relative to the traveling leg 42 once the bracket 122 has been appropriately positioned to provide the necessary tension in the working chain 100.

The mounting bracket 122 includes two pairs of posts 130 extending downwardly, with each pair supporting a bearing-lined bracket 132. The sprocket 102 rides on a shaft 134 which is supported by the bearinged bracket 132.

The working chain 100 is enclosed within a chain guard 136, except for that portion of the working chain engaging the driver wheel 94, and the chain links immediately adjacent thereto. The chain guard 136 is supported by the traveling pole 42 by means of support frames 138. The construction of the chain guard 136 may be appreciated by reference to FIGS. 11–16. Channel beams 140 and 142 are held by the support frames 138 in mutually-facing configuration to form a box-like beam. The channel beams 140 and 142 are equipped with runners 144 and 146 respectively, welded within the corresponding channel beams and running generally throughout their lengths (FIGS. 11 and 16). The back leg of the chain guard 136 is similarly constructed of a pair of channel beams each fitted with such a runner.

The working chain 100 is composed of a sequence of links, with a plurality of such links equipped with retaining plates 148. Each of the retaining plates 148 is of a size to permit the plate to move along the interior of the chain guard 136 but not to move out of the narrow troughs defined by the channel beams 140 and 142 and their respective runners 144 and 146. The bottom of the chain guard 136 includes an arcuate cover 150 bolted to the channel beams at 152. Consequently, the working chain 100 is constrained against lateral movement by the chain guard 136 throughout the length of the chain 100 except for those portions of the chain directly engaging the sprocket wheels 94 and 102, and immediately adjacent thereto. Further, the portion of the chain 100 in the vicinity of the lower wheel sprocket 102 is nevertheless encased by the continuation downwardly of the outer channel beams and the cover 150 bolted thereto. Thus, in the event that the working chain 100 breaks, for example, any portions of the chain tending to fall will be confined by the chain guard 136, and particularly by the retaining plates 148 being restrained by the runners 144 and/or 146. Consequently, it may be expected that a break in the chain 100 will result in little more than the chain supporting itself within the chain guard in a limp condition, without any substantial falling chain.

A similarly-constructed chain guard 136 also encloses the working chain 96, and is likewise supported by the traveling pole 46 by frames 138. The working chain 96 is also equipped with a plurality of retainer plates riding in the trough formed by runners in the corresponding chain guard 136 to prevent the chain 96 from falling out of the chain guard.

As shown in FIG. 10, the working chains 96 and 100 are joined together by two hoisting bars 154 and 156. Each of the ends of the hoisting bars 154 and 156 features a U-shaped retainer 158 joined to the remainder of the hoisting bar by a pair of spaced pins 160 (only one visible in FIG. 16). The pins 160 pass through holes in both sidewalls of the retainer 158. One pin 160 also passes through holes in an adjacent chain link 162; the second pin 160 (hidden in FIG. 16) similarly passes through holes in an adjacent chain link toward the opposite end of the retainer 158. An interior chain link 164 also encircles the two pins 160 and completes the hoisting bar link assembly.

The retainer 158 is joined to an end cap 166 which is held, by bolts 168, to a threaded receptacle 170. The pins 160 pass through holes 166*a* in the end cap, and are stopped by pin caps 160*a* or the like.

A cylindrical bar 172 features threaded ends, one of which is received in threaded engagement by each of the receptacles 170. A set screw 174 prevents the bar 172 from inadvertently unthreading from the receptacle 170.

A hoisting bar sleeve 174 encloses the greater portion of the length of the bar 172. A plurality of roller bearings 176 is maintained in inner and outer roller bearing raceways 178 and 180, respectively. The raceways 178 and 180 are held against longitudinal movement along the hoisting bar by an internal shoulder 174*a* of the sleeve 174, and a snap ring 182 held in an appropriate groove in the bar 172 as a stop abutting the inner raceway 178. The sleeve 174 fits loosely around the bar 172. The roller bearings 176 and raceways 178 and 180 thus provide a constraint to prevent movement of the sleeve 174 along the longitudinal axis of the bar 172, but permit relative rotational movement between the bar 172 and the sleeve 174 about their common longitudinal axis.

A seal retainer 184 is threadedly engaged with the end of the sleeve 174, and locked thereto by a set screw 186. The retainer 184 is shaped so as to avoid contact between the retainer and either the bar 172 or the receptacle 170. However, an annular seal element 188 is contained within the retainer 184 and provides a fluid-tight seal between the retainer and the surface of the bar 172. The seal element 188 is of a folded-back design, with its innermost edge bevelled and riding about the surface of the bar 172. The seal element 188 thus forms an annular pocket 190. Thus, the annular spacing between the bar 172 and the sleeve 174 may be filled with lubricant. This lubricant may also fill all open spaces around and about the roller bearings 176 and raceways 178 and 180, and also fill the pocket 190. The seal element 188 then functions to provide an end seal to retain the lubricant within the aforementioned areas. Thus, frictional forces tending to inhibit the rotational motion between the bar 172 and the sleeve 174 are minimized.

As in the case of the coupling between the retainer 158 of each hoisting bar and the corresponding working chain, the construction and assembly of the housing bar elements 158–188 is essentially the same for all hoisting bar ends.

Figure 17A:
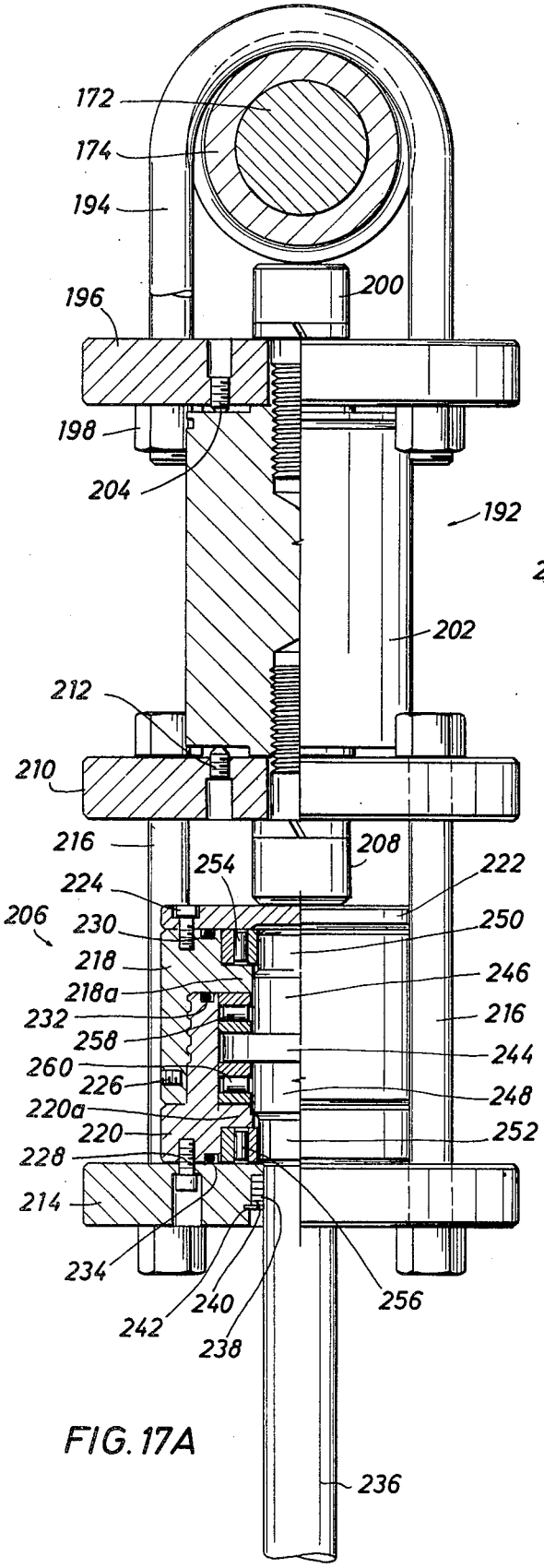
FIGS. 17A and 17B together are a side elevation, in partial section, of one of the hoist assemblies, illustrating a hoisting bar and an elevator, with FIG. 17A showing the hoisting bar and the elevator swivel, and FIG. 17B showing the elevator.
Figure 17B:
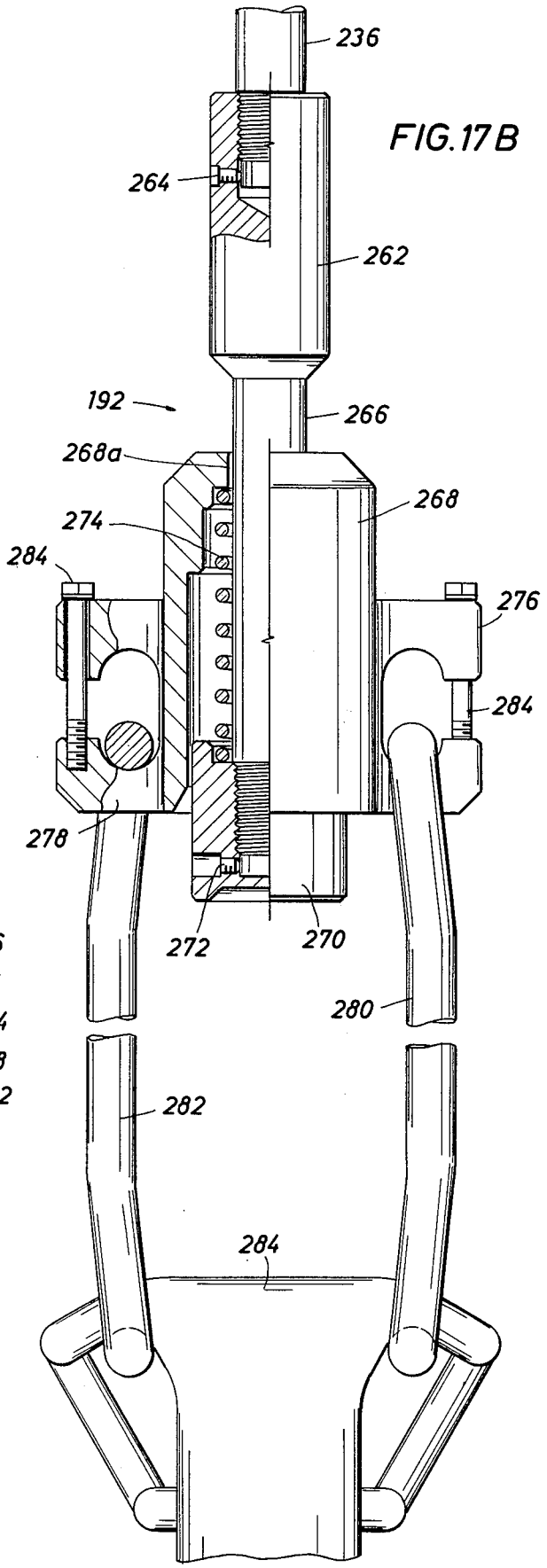

Each of the two hoisting bars 154 and 156 supports a hoist assembly, or pipe holder, shown generally at 192 in FIGS. 17*a* and 17*b*. Each of the hoist assemblies 192 is carried by a pair of U-bolts 194 secured in appropriate grooves in the hoisting bar sleeves 174. The U-bolts pass through holes in a plate 196 and are held, against shoulders (not shown) of the U-bolts, by nuts 198. A positioning bolt 200 is threaded into the top end of a coupling shaft 202. The bolt 200 is adjusted so that it fits tightly against the sleeve 174 when the nuts 198 are fastened on the U-bolts 194. Thus, the hoist assembly 192 is held fixed to the sleeve 174 against rotational as well as translational movement relative thereto. One or more set screws 204 holds the shaft 202 against rotational movement about is longitudinal axis relative to the plate 196, thereby preventing inadvertent loosening of the bolt 200.

A swivel assembly, shown generally at 206, is joined to the shaft 202 by means of a second positioning bolt 208 which passes through a plate 210, which the bolt 208 holds fast against the shaft 202 by threadedly engaging the shaft. One or more set screws 212 prevents rotational movement between the plate 210 and the shaft 202, thereby preventing inadvertent loosening of the bolt 208.

Another plate 214 is fixed relative to the plate 210 by four nut and bolt combinations 216 (only two are visible in FIG. 17A).

The swivel assembly 206 includes a housing comprising, primarily, three major components: upper and lower bearing assembly retainers 218 and 220, respectively, threaded together; and a top plate 222 held to the upper bearing retainer 218 by bolts 224. The two bearing retainers 218 and 220 are held against mutual rotational movement by set screws 226. The lower bearing retainer 220 is partially closed by the plate 214. Bolts 228 prevent rotational motion between the lower bearing retainer 220 and the plate 214. O-ring seals 230, 232, and 234 provide fluid-tight sealing integrity among the housing components 222, 218 and 220 and between the lower bearing retainer 220 and the plate 214. The bolt 208 is positioned within the corresponding threaded bore of the shaft 202 so that the housing components 218–222 are held together under compressive forces between the bolt 208 and the plate 214, the latter being held to the plate 210 by the bolts 216.

An arm 236 extends downwardly from the interior of the swivel assembly 206. The arm 236 is fluid-sealed within a hole through the plate 214, through which the arm passes, the fluid-sealing being effected by packing 238 and a packing retainer ring 240 held in place against the packing by a snap ring 242 positioned within a groove in the plate 214. Consequently, a chamber is defined within the housing components 220, 222 and the plate 214, which is fluid-sealed to retain lubricating fluid for the bearing assemblies contained therein.

The arm 236 includes an annular flange 244 flanked by shoulders of enlarged diameter 246 and 248. Beyond each of the shoulders 246 and 248 are shanks of lesser diameter 250 and 252.

The upper bearing retainer 218 includes an inwardly-directed annular flange 218*a*. A roller bearing assembly 254, including a plurality of roller bearings and inner and outer annular races, is positioned between the flange 118*a* and the top plate 222 so that the roller bearings provide relatively friction-free coupling between the shank 250 and the upper bearing retainer 218. The lower bearing retainer 220 features an inwardly-directed flange 220*a*. A second roller bearing assembly 256, including a plurality of roller bearings and inner and outer races, is positioned between the flange 220*a* and the plate 214 to provide relatively friction-free coupling between the shank 252 and the lower bearing retainer 220. It will be appreciated that the roller bearing assemblies 254 and 256 prevent lateral movement, or twisting, by the arm 236 relative to the swivel assembly 206, while providing relatively friction-free coupling to permit rotation of the arm about its longitudinal axis relative to the swivel assembly.

A roller bearing assembly 258, including a plurality of roller bearings and upper and lower annular races, is positioned between the flange 218*a* and the flange 244 of the arm 236. Similarly, a roller bearing assembly 260, including a plurality of roller bearings and upper and lower annular races, is positioned between the arm flange 244 and the flange 220*a*. The roller bearing assemblies 258 and 260 act as thrust bearings, coupling the arm 236 by means of the flange 244, to the swivel 206.

By use of the roller bearing assemblies 254–260, the arm 236 is rotatable about its longitudinal axis relative to the hoisting bar 272, but is constrained against longitudinal motion along the axis of the arm 236.

The bottom end of the arm 236 is threaded and joined, thereby, to a mounting bar 262. A set screw 264 prevents inadvertent rotational motion between the mounting bar 262 and the arm 236. The lower end of the mounting bar 262 is narrowed to a shank 266 which passes into the interior of a spring housing 268, and is threadedly connected to a collar 270. A set screw 272 prevents inadvertent rotational motion between the collar 270 and the shank 266. A coil spring 274 is confined within the housing 278 by the collar 270 and in inwardly-directed shoulder 168*a* of the housing. The collar 270 may be drawn within the housing 268. Thus, longitudinal motion between the shank 266 and the housing 268 is permitted, although the coil spring 274 biases the shank 266 downwardly relative to the housing 268 as viewed in FIG. 17B.

Two brackets 276 and 278 extend outwardly from the spring housing 268, and receive elevator links 280 and 282, respectively. The elevator links 280 and 282 are basically loops which, after being received by the brackets 276 and 278 are retained therein by bolts 284. The links 280 and 282 fit loosely within the brackets 276 and 278, respectively, permitting sideways movement of the links relative to the housing 268 and, therefore, the arm 236. The links support an elevator coupling 284 for engaging and supporting pipe members, as discussed in detail hereinafter.

Figure 18:
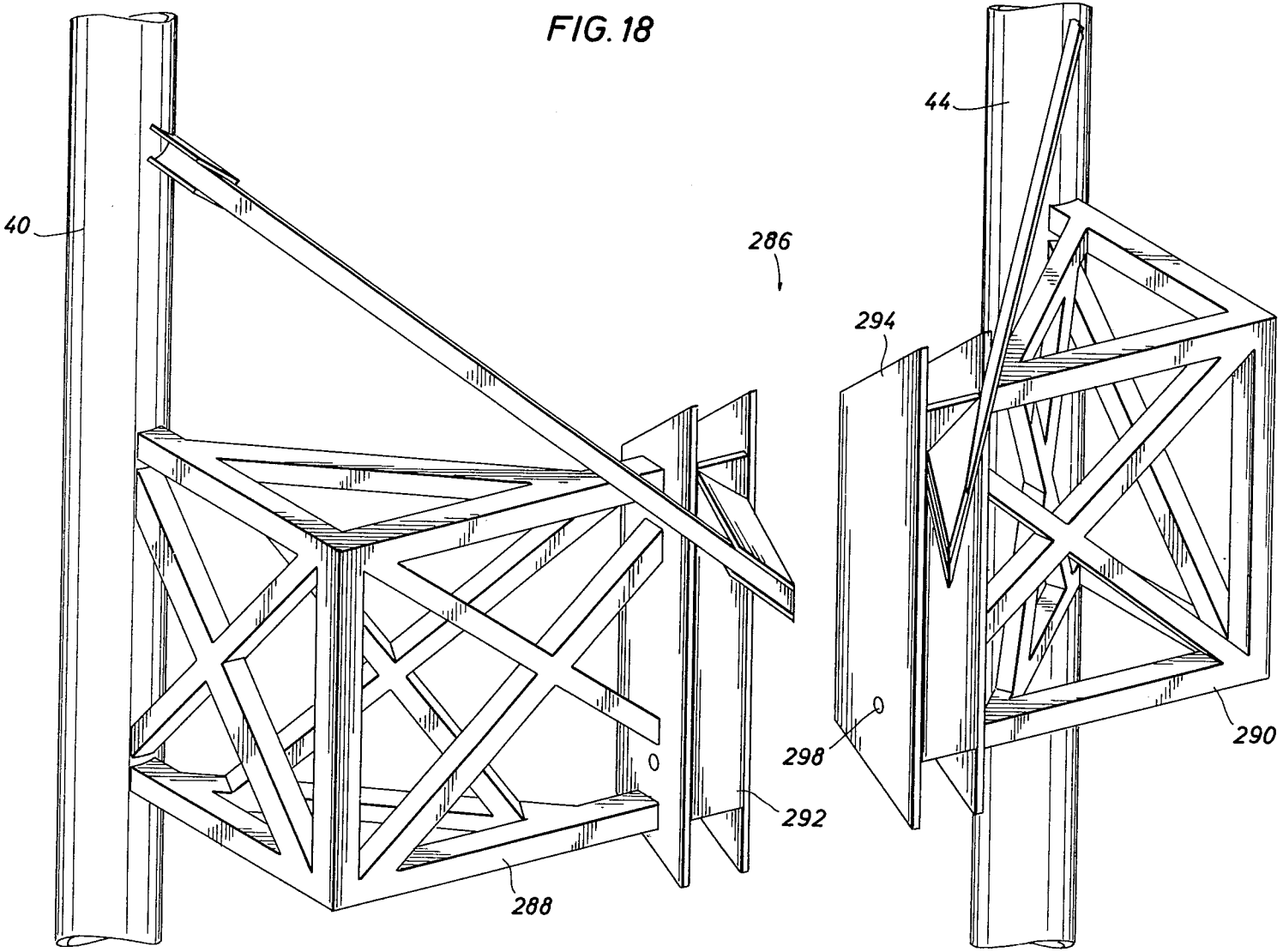
FIG. 18 is a perspective view of the hoisting mechanism framework.
Figure 21:
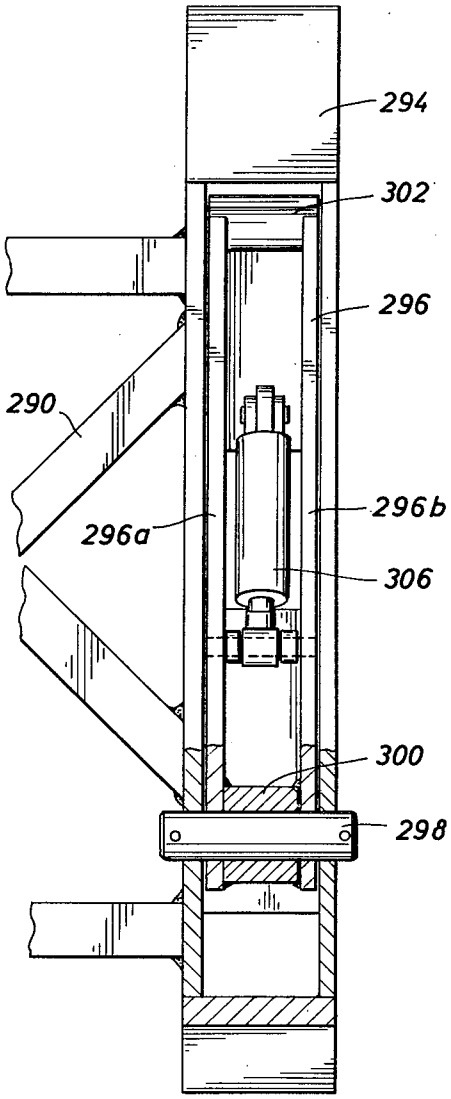
FIG. 21 is a fragmentary end elevation, partially broken away, of the hoisting clamp of FIG. 19, taken along line 21—21 of FIG. 19.

A hoisting mechanism, shown generally at 286 in FIG. 18, is affixed to the front of the mast 12. Details of the hoisting mechanism 286 may be appreciated by reference to FIGS. 11 and 18. The hoisting mechanism 286 includes a framework 288 supported by the gin pole 40, and a similar framework 290 supported by the other gin pole 44. The frameworks 288 and 290 are structurally able to support the weight of the traveling poles 42 and 46.

The framework 288 ends in a clamp housing 292 positioned a short distance in front of the working chain 100. Similarly, a clamp housing 294 is supported by the frame 290, and positioned a short distance in front of the working chain 96. Details of the housing 294 and its contents may be appreciated by reference to FIGS. 19–21, while noting that the housing 292 is of similar construction and contains like contents.

The housing 294 contains a clamp mechanism, including a clamping arm 296 pivotally joined to the housing 294 by a hinge bar 298 passing through appropriate holes in the sidewalls of the housing. As may be appreciated by reference to FIG. 21, the arm 296 includes a pair of elongate side panels **296*a* and 296*b*. The hinge bar 298 passes through a spool 300 welded between the side panels 296*a* and 296*b*. The top end of the clamp includes a curved saddle 302, also joined to the two panels 296*a* and 296*b*. An additional cross piece 304 provides added rigidity to the arm 296**.

Figure 20:
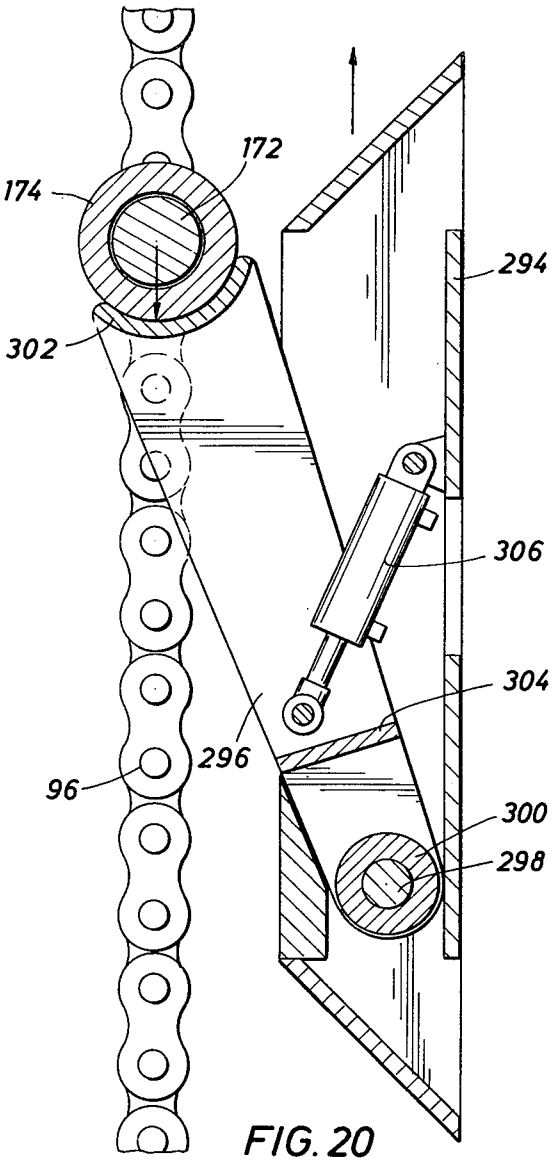
FIG. 20 is a view similar to FIG. 19, showing the arm extended and engaging a hoisting bar.
Figure 19:
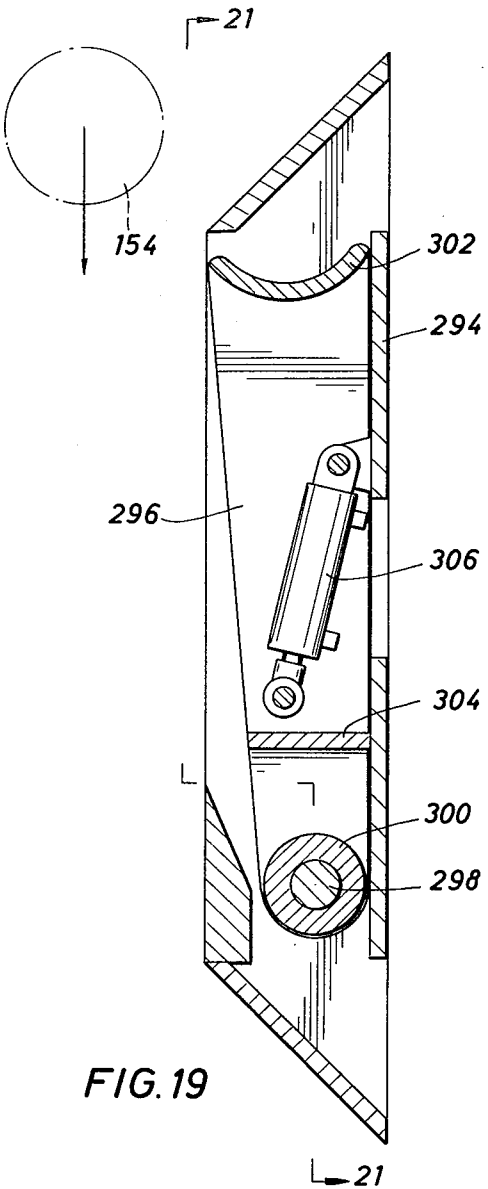
FIG. 19 is a vertical cross section of a hoisting clamp, with the arm retracted.

A fluid pressure cylinder assembly 306 is hingedly joined to the arm 296 and the back wall of the housing 294. The arm 296 may be selectively extended or retracted, by rotation about the hinge bar 298, by means of operation of the cylinder assembly 306. Thus, for example, with the cylinder assembly in its retracted configuration as shown in FIG. 19, the arm 296 is withdrawn into the interior of the housing 294. Extension of the cylinder assembly 306, as indicated in FIG. 20, causes the arm 296 to pivot outwardly. The housing 294 is so positioned in front of the working chain 96 that, with the arm 296 extended as shown in FIG. 20, the saddle 302 is placed between the two working chains 96 and 100 and in vertical alignment with either of the hoisting bars 254 or 256 passing along the front of the working chain loops. Thus, circulation of the working chains 96 and 100 to effect downward movement by the hoisting bars along the front of the working chain loops eventually causes one of the hoisting bars to be engaged by the saddle 302. With the arm 296 retracted into the housing 294 as indicated in FIG. 19, the hoisting bars may pass by the housing without contact with the arms. A hoisting bar, say 154, is shown in phantom in FIG. 19 at a position along the path the hoisting bar would take by the housing 294.

The bottom end of each of the two traveling poles 42 and 46 is equipped with a slip cone assembly, one of which is shown generally at 308 in FIGS. 22–24 and 26, supported by an end plate 310. The end plate 310 forms the bottom, or foot, of the traveling pole, such as 42, and is generally horizontal when the mast 12 is erect. An arcuate opening **310*a* in the end plate 310 receives the gin pole 40. A V-shaped passage 310*b* leads to the arcuate opening 310*a*, but is sufficiently narrow at the junction between the passage 310*b* and the opening 310*a* to prevent the gin pole 40 from passing therethrough. It will be appreciated that the sizes and shapes of the arcuate opening 310*a* and the passage 310*b* are essentially the same as those of the arcuate opening 56*a* and the passage 56*b*, respectively, of the plate 56, as illustrated in FIG. 11**.

A pair of fluid pressure cylinder assemblies 312 extend downwardly (with the mast 12 erect) from below the end plate 310 where they are held, by bolts 314, to a pillars 316 welded to the bottom of the end plate. The piston 318 of each of the cylinder assemblies 312 carries, by means of a nut 320, an angular-shaped operating plate 322. Each of the operating plates 322 extends radially inwardly, and rides in an external groove along the bottom of each of two slip cones 324. Thus, operation of the cylinder assemblies 312 causes the pistons 218 to extend downwardly or to retract upwardly. The operating plates 322 are constrained to move vertically with the corresponding pistons 318. The groove attachments between the operating plates and the slip cones 324, therefore, cause the slip cones to move vertically with the operating plates and the pistons.

An arcuate, downwardly-facing wedge member 326 is fastened to the bottom side of the plate 310 adjacent to the outside of each of the slip cones 324. With the pistons 218 retracted into the cylinder assemblies 312, as shown in FIG. 23, the slip cones 324 ride upwardly and inwardly along the inner bevelled surfaces of the wedge members 325, and are wedged tightly against the exterior surface of the gin pole 40. Each of the slip cones 324 features, along its inner surface, arcuate rows of inwardly-facing edges **324*a*, which engage the outer surface of the gin pole 40 to prevent downward movement of the plate 310 and, therefore, the traveling pole 42 relative to the gin pole, when the slip cones 324 are wedged between the gin pole and the wedge members 326 as shown in FIG. 23. When the pistons 318 are extended, as indicated in FIG. 24, the slip cones 324 are drawn downwardly relative to the wedge members 326, and are released from gripping engagement with the gin pole 40. In that case, the traveling pole 42 is not inhibited by the slip cone assembly 308 from moving longitudinally along the gin pole 40**.

A pin 328 passes through the operating plate 322 and the slip cone 324 in each case, thereby preventing lateral, or rotational, movement of each of the slip cones 324 relative to the operating plates 322 and, therefore, the wedge members 326. The pins fit firmly in appropriate holes in the bottom of each of the slip cones 324. However, each of the pins 328 may ride radially in a slot **322*a* in the corresponding retainer plate 322 to accommodate the radial movement of the slip cones 324 as they ride along the wedge members 326 (see FIGS. 25 and 25A**).

It will be appreciated that the construction and operation of the slip cone assembly associated with the traveling pole 46, operable to selectively grip the gin pole 44, is the same as that of the slip cone assembly 308 described in relation to the traveling pole 42 and the gin pole 40.

Figure 22:
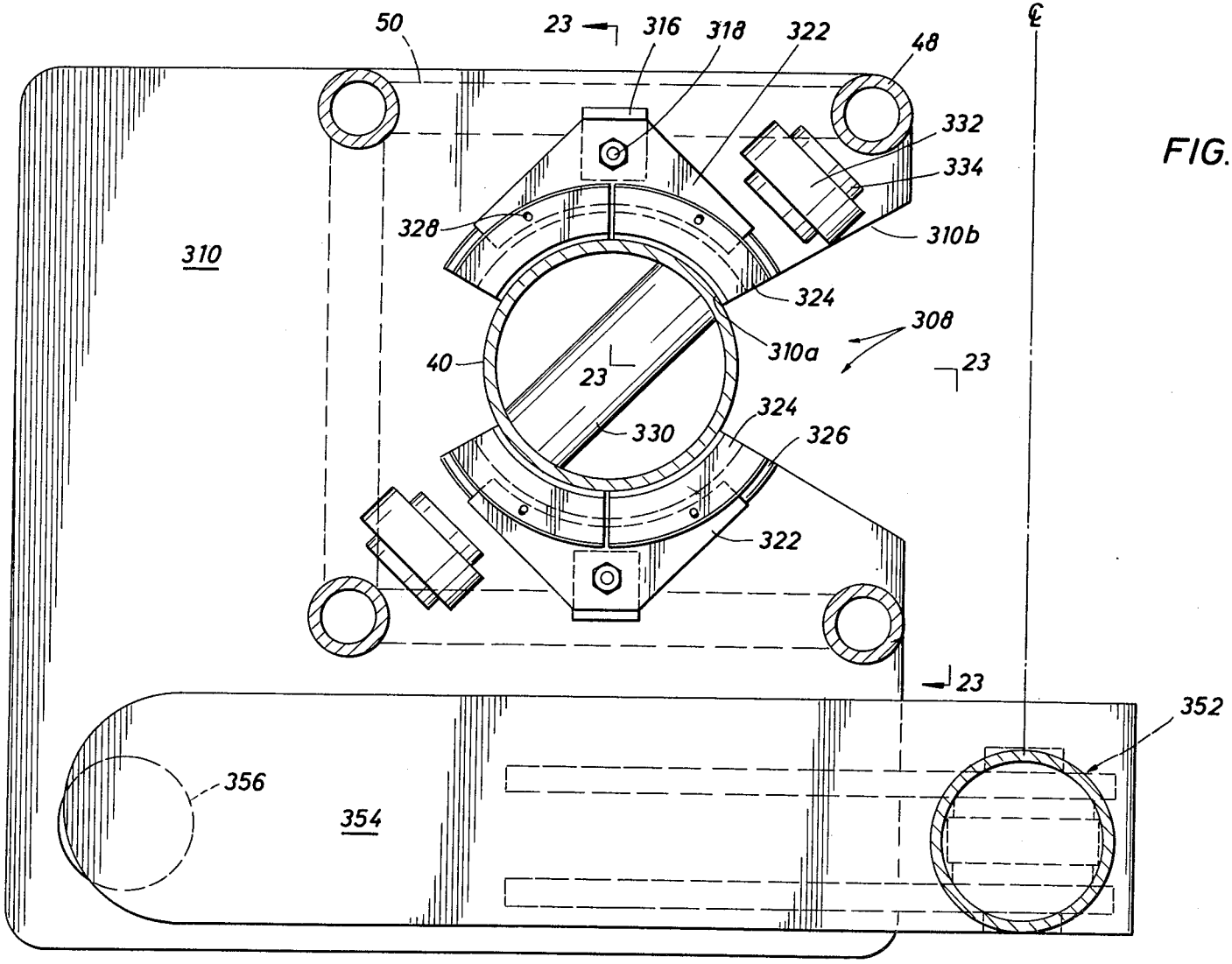
FIG. 22 is a horizontal cross section of one mast pole, taken along line 22—22 of FIG. 5, and showing the slip cone arrangement.

The gin pole 40 includes, generally toward the bottom end, a lateral sleeve 330 defining a passage through the gin pole and communicating externally of the gin pole through appropriate holes **40*a* in the wall of the gin pole (see FIGS. 22 and 26). The end plate 310 also features a pair of downwardly-extending posts 332 with ring spacers 334 welded to both sides of each post and circumscribing a bore 332*a* passing through the posts. When the mast 12 is in its retracted configuration, as in FIGS. 1–4, the posts 332 extend within the vicinity of the sleeve 330 in the gin pole 40. Then, a locking bar 336 may be passed through the sleeve 330 to extend beyond both ends of the sleeve, and, therefore, the lateral dimensions of the gin pole 40. At the same time, a pair of links 338, containing throughbores 338***a* are positioned to either side of the gin pole 40 so that the bar 336 also passes through the holes 338*a* in each of the links. On each side of the gin pole 40, the pair of links 338 are positioned to straddle the post 332 and the spacer rings 334. Each of the links 338 also features an upper throughbore 338*b* which may then be aligned with the hole 332*a* in the corresponding post 332. A load pin 340 may then be inserted through the holes 332*a* and 338*b* in the post 332 and both links 338, and locked in place by a washer 342 and nut 344. A cotter pin 346 may be added to prevent the nut 344 from disengaging from the pin 340. The head of the pin 340*a* is maintained relatively firmly against the adjacent link 338. A like load pin is locked in position in the links 338 and post 332 on the opposite side of the gin pole 40.

The load pin contacts the posts 332 and each of the adjacent links 338 to prevent longitudinal movement of the traveling pole 42 relative to the gin pole 40. Each end of the bar 336 is equipped with a lateral bore 336*a* to accommodate a cotter pin (not shown) to prevent movement of the bar out of engagement within the links 338.

It will be appreciated that a similar construction of posts 332 and a sleeve 330 are utilized on the traveling pole 46 and the gin pole 44, respectively, so that the traveling leg 46 may be locked to the gin pole 44 by means of a locking bar 336, links 338 and load pins 340 as in the case illustrated in FIG. 26. Thus, each of the traveling poles may be locked to the corresponding gin pole to secure the mast in collapsed configuration.

When the mast 12 is to be extended by raising the traveling poles relative to the gin poles, the load pins 340, the links 338, and the bar 336 may be removed from the mast leg in each case, leaving the posts 332 disengaged from the gin poles. Then, the traveling legs 42 and 46 may be moved relative to the corresponding gin poles 40 and 44.

The mast 12 may be extended by use of one or the other of the hoisting bars and the hoisting mechanism 286. With the mast 12 erect, the cylinder assemblies 306 are extended to move both clamping arms 296 into alignment with a hoisting bar as discussed. The motors 66 and 68 are operated in unison to drive the hoisting bars downwardly along the front of the working chain loops, in line with the saddles 302. As soon as one of the hoisting bars is received by the clamping arm saddles 302, continued downward driving of the hoisting bar by the motors 66 and 68 forces the traveling poles 42 and 46, to which the working chains are attached, upwardly relative to the gin poles 40 and 44, to which the hoist mechanism 286 is attached. The traveling poles 42 and 46 will continue to be lifted as long as the motors 66 and 68 continue to drive downwardly the hoisting bar so engaged by the saddles, and until the mast 12 is extended to the point that the lower sprocket wheels 98 and 102 have been elevated to the vicinity of the hoisting mechanism 286, as shown in FIGS. 5–7. Then, the circulation of the working chains 96 and 100 is stopped, and the traveling legs 42 and 46 are anchored against downward movement relative to the gin poles 40 and 44 by operation of the slip cone assemblies 303, as discussed. The clamping arms 296 are disengaged from the hoisting bar and retracted, with the motors 66 and 68 first operated to raise the hoisting bar from the saddles 302 if necessary.

To lower the mast 12 to its erect and retracted configuration, as shown in FIGS. 3 and 4, the steps just described are generally reversed. The arms 296 are extended to receive a hoisting bar in the saddles 302 as described hereinbefore. When a hoisting bar is seated in the saddles 302, the anchoring of the traveling legs 42 and 46 to the gin poles 40 and 44, respectively, by the slip cone assemblies 308 is released, as discussed hereinbefore. Then, the working chains 96 and 100 support the weight of the traveling legs 42 and 46, and of all apparatus suspended or supported by the traveling legs. The motors 66 and 68 may then be operated to allow the hoisting bar engaged by the saddles 302 to rise along the front leg of the working chain closed loops. The traveling legs thus lower themselves on the hoisting bar which remains fixed relative to the gin poles 40 and 42 as the working chains are circulated about the sprocket wheels by operation of the motors 66 and 68. At any time during the descent of the traveling legs, the motors 66 and 68 may be stopped, and the slip cone assemblies 308 actuated to anchor the traveling legs against further downward movement relative to the gin poles. Then, the clamping arms may be removed from engagement with the hoisting bar as discussed hereinbefore, and retracted.

A snubber 348 is suspended by a double-leg framework 350 generally between the lateral positions of the mast legs 12A and 12B, when the mast is in the erect configuration. As best seen in FIG. 7, one leg of the frame 350 is adjoined to the plate 310 of each of the traveling legs 42 and 46. The union between the leg 350 and the end plate 310 in each case is a hinged connection, as may be appreciated by reference to FIGS. 1, 3, 5 and 6. A hinge assembly 352 permits the snubber 348 and the frame 350 to be folded forward, towards the front of the flatbed 18. Thus, when the mast 12 is lowered to its horizontal position as shown in FIG. 1, the snubber is folded under the mast 12. As the mast 12 is extended in its erect configuration, with the traveling legs 42 and 46 moving upwardly along the corresponding gin poles 40 and 44, the snubber 348 and the rame 350 are generally lifted, and are then free to swing vertically on the hinged connection 352.

A pad 354 is rigidly connected to each leg of the frame 350 adjacent the hinged connection 352. As the frame 350 and the snubber 348 are pivotted to an erect configuration, the pads 354 swing toward the end plates 310 and abut downwardly-facing pins 356 on each of the end plates 310. Then, the contact between the frame 359 and the mast 12 is by way of the two hinge connections 352 and the contact between the two pads 354 and the pins 356.

The frame 350 also carries a foldable work basket, shown generally at 358. Details of the work basket 358 may be appreciated by reference to FIG. 9.

A rectangular plate 360 is rigidly connected to the bottom of the two-legged frame 350. The plate 360 features a central hole 360*a* through which drill pipe may be passed proceeding to and from a well below. Rearward and forward plates 362 and 364, respectively, are hingedly connected to the plate 360 by hinge joints 366. Similar hinge joints 366 connect side plates 368 to both lateral ends of the rearward plate 362. The hinge connections 366 are such that the plates 368 may be pivoted upwardly relative to the plate 362, and the plates 362 and 364 may be pivoted upwardly relative to the plate 360. However, in the flattened configuration shown in FIG. 9, wherein all plates, 360, 362, 364 and 368 are generally in a single plane, the hinge connections 366 cooperate with the edges of the plates to prevent any downward pivoting from the configuration as shown in FIG. 9. The end plates 368 may be collapsed completely against the rearward plate 362. The rearward and frontward plates 362 and 364, respectively, may be folded to an orientation at an angle of approximately 90° relative to the plate 360. In that folded configuration of the plates, the work platform 358 permits the frame 350 to swing forward of the gin poles 40 and 44. In the unfolded configuration, however, the end plates 368 of the work platform 358 extend behind and beyond the gin poles 40 and 44, as may be appreciated by reference to FIGS. 5–7 and 11.

The periphery of the work platform in its unfolded configuration of FIG. 9 contains a plurality of receptacles 370 which, with the work platform so unfolded, may receive posts 372 which support chain or cable 374 to provide a railing around a portion of the periphery of the work platform 358. The posts 372 may be removed from the receptacles 370 for the purpose of permitting the work platform 358 to be folded about the hinge connections 366.

The mast 12 features an additional foldable component which may be utilized to support a platform, or a work area, such as the control console 22. A pair of leg assemblies shown generally at 376 in FIGS. 3, 5 and 6 is pivotally mounted at points 378 on the masts. Each of the legs in the assembly 376 includes a first segment 380 joined to the mast by the pivotal connection 378, and a second segment 383 connected to the opposite end of the first segment by a pivotal, or hinged connection 384. With the mast in the erect configuration of FIGS. 3, 5 and 6, the leg assemblies 376 may be extended, or unfolded. To carry out this operation, a winch line 386 may be extended from a winch included in the power assembly 24 to a pulley carried by the pulley support frame 76 and then connected to the leg assembly 376 in the vicinity of the hinged connection 384 on each of the two legs 376. As the winch is operated to lower the legs 376, as indicated by arrows A in FIG. 5, the first leg segments 380 pivot about the connections 378 while the second leg segments 372 retain their vertical orientation, pivoting relative to the first segments 380 about the connections 384. consequently, as the first segments are rotated about the connection points 378, the second segment of each of the two legs 376 travels outwardly and downwardly relative to the position of the mast 12.

The control console 22 includes a pair of upright generally tubular members 388 which receive the pair of second leg segments 382 as the latter are lowered on the winch line 386. To accomplish this, the control console must be placed at the appropriate position on the skid 16 to receive the leg second segments 382. As may be appreciated by reference to FIG. 6, when the bottom of each of the second leg segments 382 contacts the skid 16, the first leg segments 380 are generally horizontally oriented. A pair of receptacles 390 fixed to the skid receive the bottom ends of the second leg segments 382 when the latter have passed through the control console members 388. Then, each of the legs 376 is anchored against lateral motion at two points, namely the hinged connection 378 and the receptacle 390. Consequently, as long as the legs 376 are not lifted, they are sufficiently rigid to support the control console 22 as follows.

With the leg assemblies 376 unfolded and positioned with the ends of the second leg segments in the receptacles 390, the winch line 386 may be removed from the leg assembly 376 and extended downwardly to be fastened to a point on the control console 22 generally toward the back of the skid 16. The winch of the power source 24 may then be operated to draw in the winch line 386, thereby causing the control console 22 to ride up along the second leg segments 382, which are contained within the tubular members 388 and held by the receptacles 390. Thus, as the winch line 386 is drawn by the power source 24, the control console 22 rides vertically upwardly along the second leg segments 382 which serve as tracks. When the desired height of the control console 22 is reached, pins may be inserted in appropriate holes in the tubular members 388 and through corresponding holes in the second leg segments 382 to lock the control console against movement relative to the second leg segments 382. Then, the winch line 386 may be removed from the control console 22, which will remain locked in the configuration elevated above the skid 316.

To lower the control console 22, the procedure is generally reversed, with the winch line 386 being fastened to the control console and pulled tight by the winch of the power system 24. The pins locking the control console 22 against movement relative to the second leg segments 382 are removed, leaving the winch line 386 to prevent downward movement by the control console. The winch line 386 is then paid out slowly, allowing the control console 22 to ride downwardly along the upright second leg segments 382, serving as tracks. When the control console 22 contacts and rests on the skid 16, the winch line 386 may be removed from the control console. With the control console 22 thus supported by the skid 16, the leg assemblies 376 may be folded against the mast 12 in anticipation of the mast being folded forward over the skid 16.

To accomplish the folding of the leg assemblies 376, the winch line 386 is joined to the two leg assemblies at or near the pivot connections 384, and the winch line is drawn in by the winch of the power source 24. As the winch line 386 is thus retracted, the first leg segments 380 pivot about their corresponding connections 378 with the mast gin poles, while the second leg segments 382, remaining vertically oriented, are moved upwardly and toward the mast 12, with both first and second segments 382 and 380 very nearly parallelling the mast, as shown in FIG. 3. The leg assemblies 376 may then be fastened to the structure of the gin poles 40 and 44, thereby held secure against the mast 12 when the mast is folded to its horizontal configuration, such as in FIGS. 1 and 2.

Figure 30:
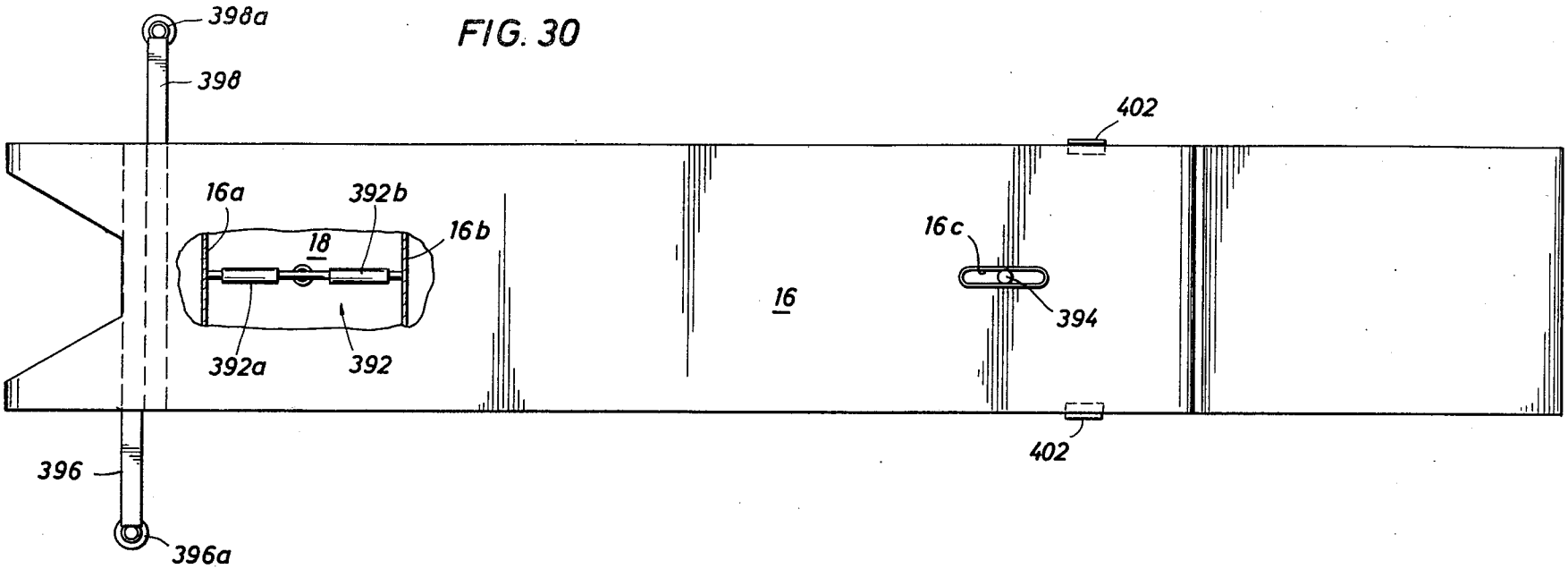
FIG. 30 is a top plan view of the rig truck bed and skid partially broken away, showing the pin-in-slot and the double cylinder assembly for positioning the skid on the truck bed.
Figure 31:
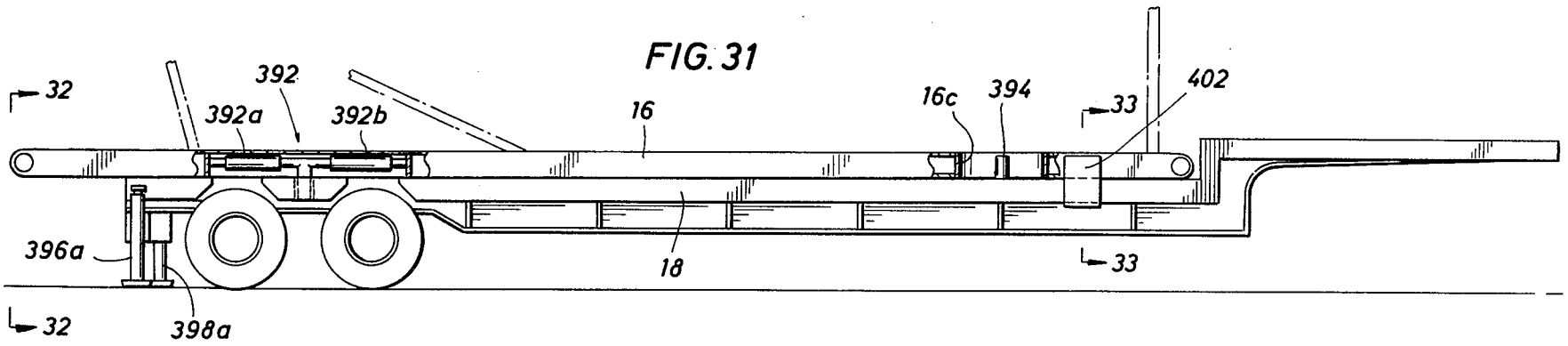
FIG. 31 is a side elevation of the skid and truck bed.

Horizontal adjustments of the skid 16 may be made by utilizing a double-cylinder system, shown generally at 392 in FIGS. 30 and 31, which couples the skid 16 to the flatbed 18. The double-cylinder system 392 includes two fluid pressure operated piston-and-cylinder assemblies 392*a* and 393*b*, with their fluid chambers in common communication with a fluid pressure source (not shown). The assembly 392 is constructed so that application of pressure to extend one of the fluid cylinder assemblies 392*a* or 392*b* operates to retract or to allow retraction of, the other of the two cylinder assemblies. Each of the cylinder assemblies 392*a* and 393*b* is in contact with a cross member 16*a* and 16*b*, respectively, of the skid 16. Consequently, operation to extend the rearward cylinder system 392*a*, and coincidently retract the forward cylinder assembly 392*b*, generates a force against the cross member 16*a*, while allowing the cross member 16b to move toward the assembly 392. With the fluid cylinder assembly 392 anchored relative to the flatbed 18, the skid 16 is then propelled toward the rear of the flatbed. Operation of the fluid cylinder system 392 to extend the forward cylinder 392b and to retract the rearward assembly 392a propels the skid 16 toward the forward end of the flatbed 18.

A pin 394 projecting upwardly from, and fixed rigidly to, the flatbed 18 is confined within a slot 16c in the skid 16, oriented along a backward and forward direction along the skid. The confinement of the pin 394 within the slot 16c ensures that the operation of the double cylinder assembly 392 results only in longitudinal motion of the skid 16 relative to the longitudinal axis of the flatbed 18.

Figure 32:
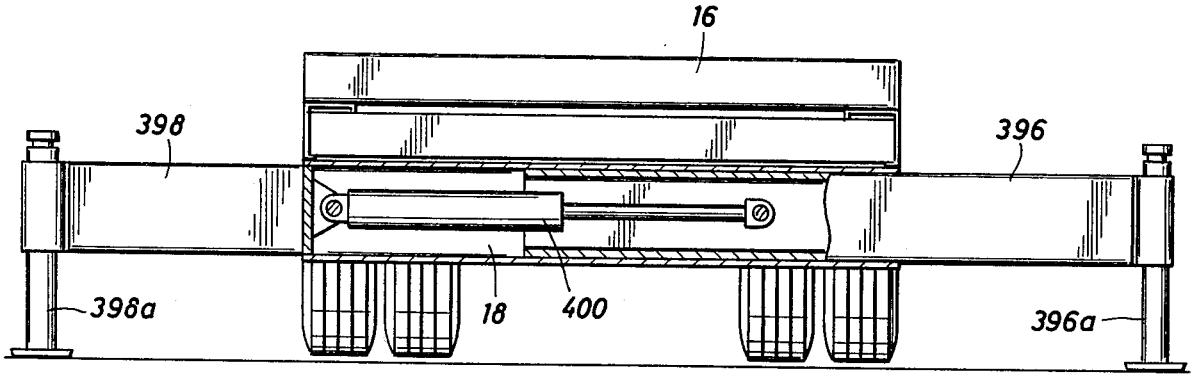
FIG. 32 is an end elevation of the skid and truck bed, partially broken away, taken along line 32—32 of FIG. 31, and illustrating the outrigger cylinder assembly.

When the flatbed 18 has been driven into position with its rear generally centered on a well site so that the substructure frame 14 extending beyond the flatbed, straddles the well site, fine adjustments in the orientation of the substructure relative to the well site may be made along the longitudinal axis of the flatbed by operation of the double cylinder system 392 as described. Lateral, or sideways adjustments of the skid 16 may also be made by use of fluid pressure. The flatbed 18 is equipped with a pair of outriggers 396 and 398, ending in feet 396a and 398a, respectively. With the outriggers 396 abd 398 extended, the feet 396a and 398a may be lowered to contact the surface of the ground, and further advanced downwardly relative to the flatbed 18 to raise the rear wheels of the flatbed off of the ground, as shown in FIG. 32. The extension of the outrigger 396 may be accomplished by operation of a fluid pressure cylinder assembly 400, which has its cylinder anchored relative to the flatbed 18 and its piston anchored relative to the outrigger 346 as illustrated in FIG. 32. A similar fluid pressure cylinder assembly (not shown) may be employed to maneuver the opposite outrigger 398 inwardly and outwardly relative to the flatbed 18. With the rear wheels of the flatbed raised off of the ground, and the flatbed being supported by the outrigger feet 396a and 398a as well as the fifth-wheel truck 20 at the front of the flatbed, the fluid pressure cylinder assemblies, including 400, used to operate the extension and retraction of the outriggers 396 and 398 may be operated in unison to swing the rear end of the flatbed 18 and, therefore, that of the skid 16 laterally relative to the longitudinal axis of the flatbed. Thus, to move the rear of the truck to the right as viewed in FIG. 32, the cylinder assmbly 400 is retracted at the same time the outrigger 398 is extended further from the flatbed 18 by operation of the corresponding fluid pressure cylinder assembly (not shown). This latter cylinder assembly may be retracted while the cylinder assembly 400 is extended to move the rear of the truck to the left as viewed in FIG. 32.

By utilizing the outrigger fluid pressure cylinder assemblies as well as the double cylinder system 392 the skid 16 may be moved in two generally horizontal directions which are generally mutually orthogonal. Thus, a complete fine adjustment of the positioning of the centerline of the mast 12, when the mast is erected, may be made without the necessity of further manuevering of the flatbed 18 by means of the truck 20.

Figure 33:
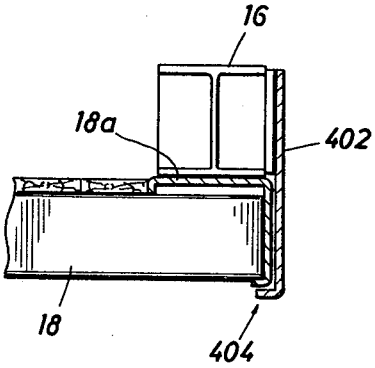
FIG. 33 is an enlarged, fragmentary horizontal cross section of an edge of the skid and truck bed, showing the rail of the truck bed supporting the skid.

To ensure that the skid 16 is constrained against rotational, or sideways motion relative to the longitudinal axis of the flatbed 18, one or more sidewalls 402 are rigidly joined to the outer frame of the skid 16 as illustrated in FIG. 33. The sidewalls 402 extend downwardly along the side of the flatbed 18, and wrap around under the edge of the flatbed, as illustrated generally at 404. Thus, by cooperation of the sidewalls 402, the pin-in-slot combination 394 and 16c, and the connection between the double cylinder system 392 and the cross members 16a and 16b, the skid 16c is held relatively fast to the flatbed 18 with the exception of the skid being able to be moved back and forth along the longitudinal axis of the flatbed 18.

As shown in FIG. 33, the flatbed 18 may be equipped with metal rails 18a to provide direct support for the skid 16, and a sliding surface over which the skid may be moved by operation of the double cylinder system 392.

Figure 27:
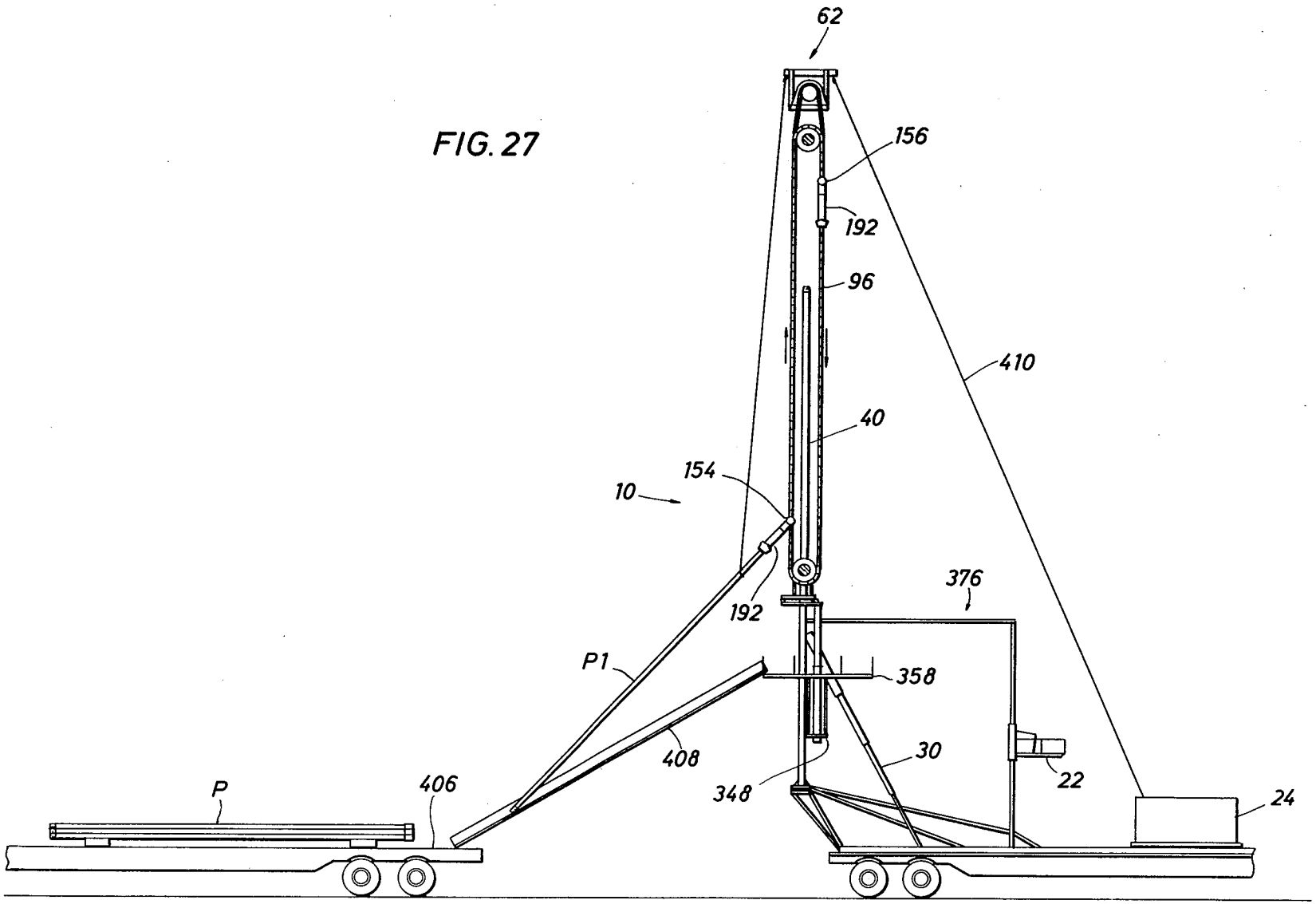
FIG. 27 is a schematic, partial side elevation of the well working rig showing a pipe segment being lifted from a truck bed by one of the elevators.
Figure 29:
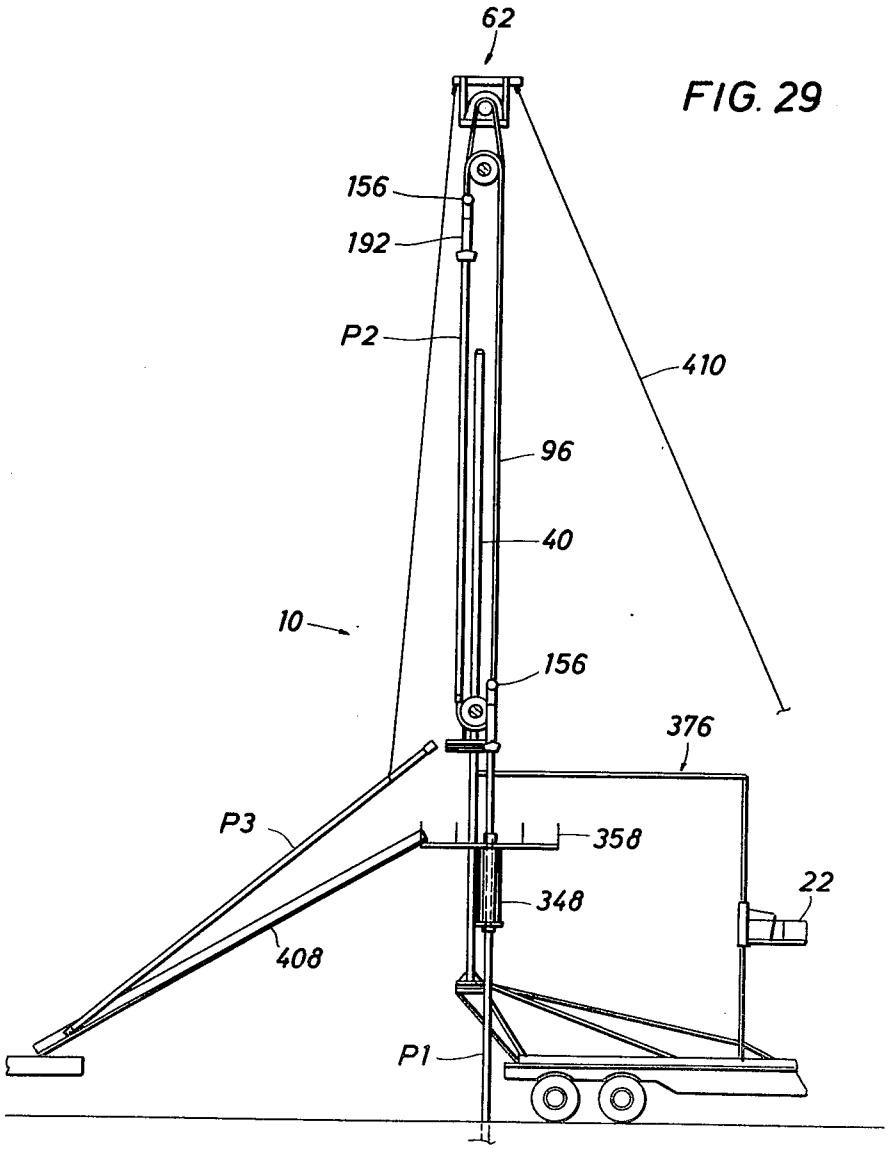
FIG. 29 is a view similar to FIGS. 27 and 28, showing the first pipe segment lowered through the snubber into the well by the first elevator, the second pipe segment raised by the second elevator, and a third pipe segment raised into position by a winch line to be engaged by the first elevator.
Figure 28:
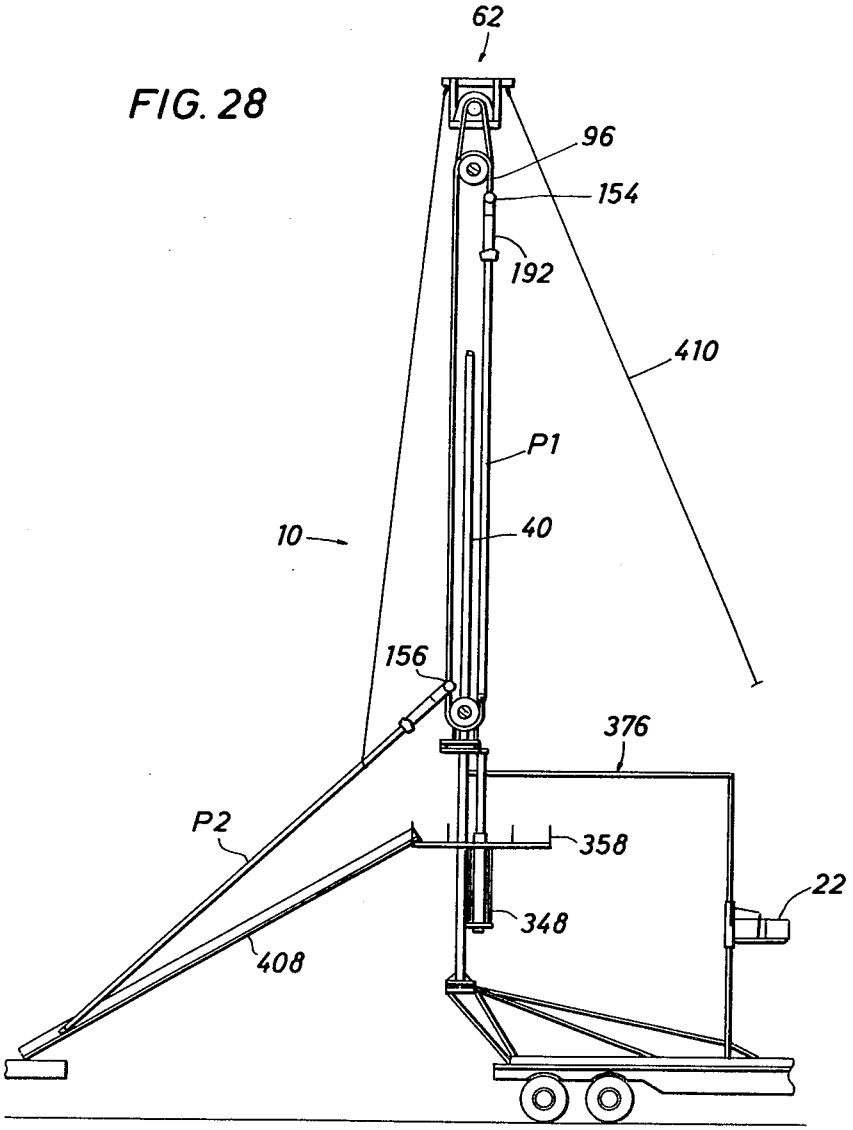
FIG. 28 is a view similar to FIG. 27, but showing a second pipe segment being lifted by the second elevator and the first pipe segment supported over the well by the first elevator.

FIGS. 27–29 illustrate the manipulation of pipe members into, and out of, a well by means of the well working rig 10. For purposes of clarity, only certain features of the apparatus are illustrated in FIGS. 27–29.

The flatbed 18 is maneuvered into position adjacent the well site, and any necessary fine adjustments are made as described to position the skid 16 so that, with the mast 12 erect, the pipe handlers 192 supported along the forward legs of the working chain loops will be aligned with the centerline of the well. The mast 12 is then erected and extended as described hereinbefore. The snubber 348 is swung into position over the well site, and the work basket 358 is unfolded. The leg assemblies 376 are lowered, and the control console 22 raised along the leg segments 382.

A collection of pipe members P may be provided toward the back of the rig 10 as shown in FIG. 27. Such pipe members may be transported by means of a truck 406. If necessary, a pipe ramp 408 may be extended from the truck 406 to the rearward edge of the work platform 358 to support pipe members being moved between the truck 406 and the mast 12. A winch line 410 may be extended from a winch of the power assembly 24 through pulleys contained in the masthead 62 and down to the pipe members P to the rear of the rig 10. A pipe member P1 may be engaged by the winch line 410, and the power assembly 24 operated to retract the winch line. Then, the pipe member P1 is raised toward the mast 12 as the lower end of the pipe member rides along the ramp 408. The upper end of the pipe member P1 may be engaged by the elevator of the pipe handling device 192 is supported by, say, the hoisting bar 154. At this point, the hoisting bar 154 is positioned along the back leg of the working chain closed loops, and toward the lower end of the loops; the other hoisting bar 156 is positioned toward the top of the front of the closed loops. With the pipe member P1 engaged by the pipe holder 192, the winch line 410 may be disengaged from the pipe member P1. Then, the power assembly 24, controlled at the control console 22, may be operated to rotate the motors 66 and 68 of the masthead assembly 62 to circulate the working chains and thereby raise the hoisting bar 154 and pipe member P1 supported thereby. As the working chains are so circulated, the pipe member P1 is lifted off of the ramp 408 and assumes a vertical orientation. The hoisting bar 154 passes over the top of the driver wheels 90 and 94, with the pipe member P1 passing generally between the working chains 96 and 100.

FIG. 28 illustrates the position and orientation of the pipe member P1 just after it has passed between the sprocket wheels, and is suspended along the front legs of the working chain closed loops. The other hoisting bar 156 is then positioned at the lower end of the back leg of the working chain closed loops, at a position to receive the next pipe member P2. The winch line 410 is again extended toward the collection of pipe members P to engage the next pipe member P2, and the power assembly 24 is operated to raise the pipe member P2 to the position shown in FIG. 28. Then, with the lower end of the pipe member P2 still resting on ramp 408, the elevator of the pipe handler 192 supported by the hoisting bar 156 is made to engage the upper end of the pipe member P2, and the winch 410 is disengaged from the pipe member.

Continuing operation of the motors 66 and 68 lowers the pipe member P1 to the snubber 348 which may be used to force pipe members into the well. A blowout preventer and various other well site devices may be positioned between the well and the bottom of the snubber 348 as needed.

If a pipe member is already present in the well, the pipe member P1 may be rotated by appropriate means to effect a threaded connection between the pipe member P1 and the pipe member in the well. The working chains and the hoisting bars may be held stationary during such threading operation, in which event the spring 274 within the pipe handler 192 supporting the pipe member P1 may be compressed in allowing the elevator 284 to be lowered relative to the hoisting bar 154 as the threads of the pipe member P1 advance downwardly along the threads of the pipe member already in the well.

The elevator supported by the hoisting bar 154 may then be disengaged from the pipe member P1, and the motors 66 and 68 operated to advance the working chains again. As the pipe member P1 is lowered through the snubber 348, the second pipe member P2, supported by the hoisting bar 156, is raised to the position shown in FIG. 29. The winch line 410 is employed to engage a third member P3 and raise it to the position shown in FIG. 29 in anticipation of the hoisting bar 154 being moved into position to support the pipe member P3. With the pipe member P1 supported by the snubber 348, the elevator suspended below the hoisting bar 154 is disengaged from the pipe member P1 and the working chains further circulated to move the hoisting bar 154 into the position shown generally in FIG. 27. At that point, the hositing bar 156 has been advanced to align the second pipe member P2 over the well site for lowering and engagement to the pipe member P1.

These steps are repeated until the desired pipe string is made up in the well. To remove such a pipe string from the well, the aforementioned steps are generally reversed. Thus, an elevator supported by a hoisting bar engages a pipe member projecting upwardly from the well, and the motors 66 and 68 are operated in the opposite rotational sense to raise the hoisting bar above the well site. Thus, the working chains are circulated in the rotational sense opposite to that used to run pipe into the well. Once the pipe member is clear of the snubber 348, it may be disengaged from the pipe member below. Again, the spring 274 in the pipe handler 192 permits, if necessary, upward movement of the pipe member during the unthreading operation without movement of the working chains.

Circulation of the working chains may then be affected to move the pipe member just taken from the well to the position of the bakc legs of the working chain closed loops. The opposite pipe handler 192 is then in position to engage the next pipe member protruding from the snubber 348. Once the next pipe member has been engaged by the elevator supported by the opposite bar, the working chains are again circulated to lower the first pipe member onto the ramp 408 as the next pipe member is being raised above the snubber 348. With the first pipe member in the position shown generally in FIG. 28 for the pipe member P2, the winch line 410 is used to engage the upper end of that pipe member while the elevator is disengaged therefrom. Then, the first pipe member may be lowered back onto the truck 406, as the working chains are further operated to move the second pipe member removed from the well into position over the ramp 408. The elevator supported by the first hoisting bar may then engage the next pipe member to be removed from the well. This procedure is repeated until all of the pipe members desired are removed from the well and advanced to the truck 406.

Two motor winches 412 and 414 are mounted on the lower ends of the traveling poles 42 and 46, respectively. These motor winches 412 and 414 may be utilized in combination with winch lines extending from the respective motor winches 412 and 414 to one or more pulleys of the masthead assembly 62. Such winch lines may then be extended downwardly to engage various pieces of equipment needed to be moved. For example, one or the other of the motor winches 412 or 414 may be used in conjunction with a winch line to raise or lower the pipe members between the truck 406 and the pipe handlers 192 in the operations described in conjunction with FIGS. 27–29.

The V-shaped passages **310*b* in the end plates 310 and the V-shaped passages 56*b* and 58*b* in the centering plates 48 and 56, respectively, permit movement of the traveling poles 42 and 46 along the corresponding gin poles 40 and 44 while accommodating the attachment of the frameworks 288 and 290 on the front of the gin poles 40 and 44, respectively. Also, the folding leg assemblies 376, as well as the fluid pressure cylinder assemblies 30, are anchored on the fronts of the gin poles 40 and 44. The split in the construction of the front of each of the traveling poles 42 and 46, including the aforementioned V-shaped passages in the various plates, as well as the absence of any cross members or struts along the fronts of the traveling poles also accommodates the attachment of the folding leg assembly 376 and the cylinders 30** on the fronts of the gin poles. Thus, a two-legged telescoping mast is disclosed which also includes the fixture of various apparatus along those portions of the legs, that is, the gin poles, over which other portions are telescoped, that is, the traveling legs.

Figure 34:
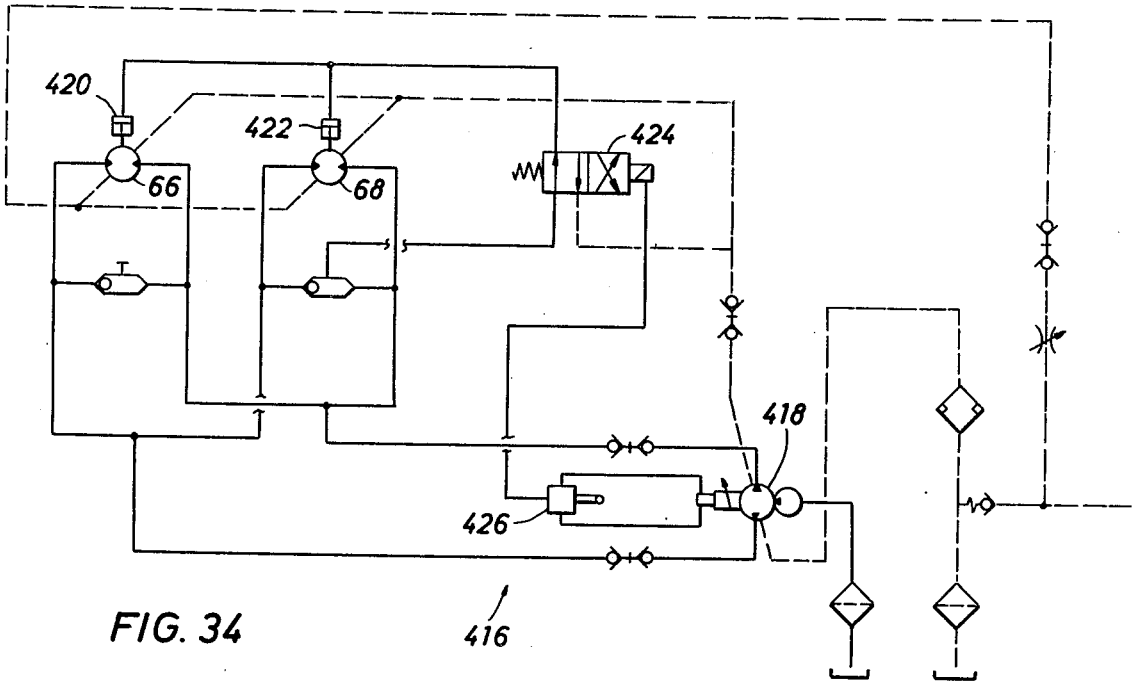
FIG. 34 is a schematic representation of a hydraulic system for operating the well working rig.

A fluid pressure system such as may be utilized in operating the rig 10 is shown schematically at 416 in FIG. 34. The masthead motors 66 and 68 used to drive the chain assembly are shown in a closed hydraulic system, powered by a pump 418. The motors 66 and 68 are thus fed by a common source, and are operated in unison. Reversal of the direction of fluid pressure application in the closed loop system reverses the direction of rotation of the pumps 66 and 68. Brake release cylinders 420 and 422 are selectively operable by means of an electrically controlled four-way, two-position valve 424. The electrical control system 426 which operates the valve 424 also controls operation of the pump 418 and, therefore, the application of fluid pressure to the motors 66 and 68.

It will be appreciated that various hydraulic systems may be utilized to operate the motors 66 and 68, as well as the various fluid pressure cylinder systems of the rig 10, and the invention is in no way limited by the particular design features of the circuit 416.

The foregoing disclosure and description of the invention is illustrative and explanatory thereof, and various changes in the method steps as well as the details of the illustrated apparatus may be made in the scope of the appended claims without departing from the spirit of the invention.

I claim:

1. Apparatus for manipulating pipe members comprising:
(a) mast means, including first pole means and second pole means selectively moveable along said first pole means, whereby said mast means may be selectively extended and retracted;
(b) chain drive means joined to said second pole means and selectively operable for movement of chain generally along said second pole means; and
(c) hoisting mechanism means, joined to said first pole means, and selectively operable to engage said chain drive means whereby said chain drive means may be so operated to cause said second pole means to so move along said first pole means.

2. Apparatus as defined in claim 1 wherein said hoisting mechanism means comprises clamp means selectively moveable between a first position in which said clamp means may engage said chain drive means and a second position in which said clamp means are withdrawn from said chain drive means.

3. Apparatus as defined in claim 1 wherein:
(a) said first pole means comprises first and second gin poles positioned generally side by side and mutually laterally displaced; and
(b) said second pole means comprises first and second traveling legs, said first traveling leg configured to telescope along said first gin pole, and second traveling leg configured to telescope along said second gin pole.

4. Apparatus as defined in claim 3 wherein:
(a) said first and second traverling legs at least partially encompass the first and second gin poles, respectively, and each of said traveling legs features an elongate slot;
(b) said hoisting mechanism comprises clamps, mounted on said first and second gin poles through said elongate slots; and
(c) said clamps are selectively moveable between a first position in which said clamps may engage said chain drive means and a second position in which said clamps are withdrawn from said chain drive means.

5. Apparatus as defined in claim 3 further comprising selectively operable locking means for locking said traveling legs against movement relative to said gin poles.

6. Apparatus as defined in claim 5 wherein said locking means comprises:
(a) a plurality of slips, carried by at least one of said traveling legs, and selectively moveable between a first position, in which said slips may engage at least one of said gin poles, and a second position, relative to said traveling legs; and
(b) wedge means, carried by at least one of said traveling legs, for cooperation with said slips, such that said slips are held in engagement with at least one of said gin poles when said slips are in said first position.

7. Apparatus as defined in claim 1 further comprising locking means, including slip means and wedge means, carried by said second pole means and selectively operable whereby said wedge means may hold said slip means in gripping engagement with said first pole means to prevent movement of said second pole means relative to said first pole means.

8. Apparatus as defined in claim 1 further comprising:
(a) said mast pivotally mounted on a base so that said mast may be folded in one direction at least partially toward a generally horizontal orientation;
(b) pipe gripping means pivotally supported by said mast so that, as said mast is so folded, said pipe gripping means may be folded in said direction to a position generally under said folded mast.

9. Apparatus as defined in claim 1 further comprising platform means elevatable along vertical support means adjacent said mast means by winch line means extending from said mast means.

10. Apparatus as defined in claim 9 wherein said vertical support means comprises leg means pivotaly connected to said mast means and generally foldable aginst said mast means.

11. Apparatus as defined in claim 1 further comprising base means on which said mast means is mounted, said base means being selectively adjustable to move said mast means in two generally mutually perpendicular directions.

12. Apparatus for manipulating pipe members relative to wells comprising:
(a) a mast having two legs, each leg including a gin pole and a traveling leg telescoping along the corresponding gin pole, with the two traveling legs mutually joined so that the mast is selectively extendable and retractable by movement of the traveling legs relative to the gin poles;
(b) chain means mounted on the traveling legs and selectively moveable along said traveling legs; and
(c) hoist means, mounted on the gin poles and selectively engagable with said chain means whereby said mast may be so extended or retracted by movement of said chain means along said traveling legs.

13. Apparatus as defined in claim 12 wherein each of said traveling legs features an elongate slot moveable generally along the corresponding gin pole as said mast is so extended or retracted.

14. Apparatus as defined in claim 13 wherein:
(a) said hoist means includes two clamps, one of said clamps mounted on each of the gin poles generally through the slot of the corresponding leg; and
(b) each clamp is selectively moveable between a first position, in which the clamp may engage the chain means so that said mast may be so extended or retracted by movement of said chain means along said traveling legs, and second position in which the clamp is withdrawn from the chain means.

15. Appratus as defined in claim 12 wherein said hoist means comprises clamp means selectively moveable between a first position for engaging said chain means and a second position wherein said clamp means is withdrawn from said chain means.

16. Apparatus as defined in claim 15 wherein:
(a) said chain comprises hoisting bar means moveable along said traveling legs as said chain means is so moveable along said traveling legs; and
(b) said clamp means in said first position may receive said hoisting bar means whereby movement of said hoisting bar means along said traveling legs may so extend or retract said mast.

17. Apparatus as defined in claim 12 further comprising locking means, mounted on at least one of said traveling legs, for locking said traveling legs against movement relative to said gin poles.

18. Apparatus as defined in claim 17 wherein said locking means comprises:

(a) a plurality of slips carried by said traveling legs and selectively moveable between a first position and a second position; and (b) wedge means carried by said traveling legs for urging said slips into gripping engagement with the corresponding gin poles, when said slips are moved into said first position, for locking said traveling legs against downward movement relative to said gin poles.

19. Apparatus as defined in claim 12 further comprising support means on which said mast is mounted.

20. Apparatus as defined in claim 19 wherein said mast is pivotally mounted on said support means and may be selectively moved about said pivot mounting between a generally erect configuration and a folded configuration.

21. Apparatus as defined in claim 20 further comprising snubber means supported by said mast and connected thereto by a second pivot mounting whereby said snubber means may be selectively rotated relative to said mast.

22. Apparatus as defined in claim 21 wherein said snubber means may be so rotated relative to said mast so that, with said mast in said folded configuration, said snubber means may be folded generally under said mast.

23. Apparatus as defined in claim 19 wherein said support means includes skid means, to which said mast is connected, positioned on base means and selectively moveable relative thereto.

24. Apparatus as defined in claim 23 wherein said support means further comprises:

(a) first adjustment means by which said skid means may be selectively moved relative to said base means along a first direction; and (b) second adjustment means whereby said base means may be selectively moved, with said skid means, along a second direction.

25. Apparatus as defined in claim 24 wherein:

(a) said base means comprises flatbed means; and (b) said second adjustment means includes outrigger means for at least partially supporting said flatbed means.

26. Apparatus as defined in claim 12 further comprising:

(a) platform means; and (b) vertical support means for cooperating with said platform means whereby said platform means may be raised along said vertical support means by line means extending from said mast.

27. Apparatus as defined in claim 26 wherein said vertical support means comprises a pair of folding legs pivotally connected to said mast and which are selectively moveable between a folded configuration with said folding legs generally against said mast, and a support position in which at least a portion of each of said folding legs is oriented generally vertically to serve as a track along which said platform means may be moved.

28. A method of operating on a well comprising the following steps:

(a) providing a mast, for supporting equipment related to the well, the mast including a first leg portion and a second leg portion that is moveable longitudinally relative to the first leg portion; and (b) selectively propelling chain means generally longitudinally along the second leg portion while engaging the chain means by clamping means mounted on the first leg portion to so move the second leg portion longitudinally relative to the first leg portion to thereby selectively extend or retract the mast.

29. A method as defined in claim 28 further comprising the step of locking the second leg portion against downward movement relative to the first leg portion by wedging slip means, carried by the second leg portion, against the first leg portion.

30. A method as defined in claim 28 further comprising the following steps:

(a) clamping the first leg portion to the chain means; and (b) moving the chain means upwardly along the second leg portion to lower the second leg portion relative to the first leg portion to retract the mast.

31. A method as defined in claim 28 further comprising the following steps:

(a) clammping the first leg portion to the chain means; and (b) moving the chain means downwardly relative to the second leg portion to raise the second leg portion relative to the first leg portion to extend the mast.

32. A method as defined in claim 31 further comprising the step of locking the second leg portion against downward movement relative to the first leg portion by weding slip means, carried by the second leg portion, against the first leg portion.

33. A method as defined in claim 28 further comprising the step of providing the mast with a pivotal mounting so that the mast may be rotated between an erect configuration and a generally folded configuration.

34. A method as defined in claim 33 further comprising the following steps:

(a) providing a snubber pivotally supported from the mast; and (b) rotating the mast toward the generally folded configuration and rotating the snubber in the opposite rotational sense to position the snubber generally under the mast.

35. A method as defined in claim 33 further comprising the following steps:

(a) providing a snubber pivotally supported from the mast; and (b) rotating the mast from the generally folded configuration to the erect configuration and rotating the snubber in the generally opposite rotational sense to orient the snubber generally vertically.

36. A method as defined in claim 33 further comprising the step of disengaging the clamping means from the chain means.

37. A method as defined in claim 33 or, in the alternative, as defined in claim 28 further comprising the steps of:

(a) providing support means including a skid, on which the mast is mounted, mounted on a base and selectively moveable relative thereto; and (b) adjusting the lateral position of the mast by moving the skid relative to the base in one direction or another.

38. A method as defined in claim 33 or, in the alternative, as defined in claim 28 further comprising the step of providing a leg assembly collapsible generally against the mast and including a vertical portion.

39. A method as defined in claim 38 further comprising the following steps:

(a) unfolding the leg assembly to position the vertical portion displaced from the mast;

(b) raising a platform along the vertical portion of the leg assembly by a line extending from the mast to the platform; and (c) locking the platform to the vertical portion of the leg assembly at a selected height.

40. A method as defined in claim 38 further comprising the following steps:

(a) lowering a platform along the vertical portion of the leg assembly by a line extending from the mast; and (b) raising the leg assembly to folded configuration generally against the mast by a line extending from the mast.

41. A method of manipulating apparatus for working on wells comprising the following steps:

(a) providing a mast equipped with a first leg portion and a second leg portion that is moveable longitudinally relative to the first leg portion;

(b) providing chain means arrayed generally longitudinally along the second leg portion and selectively moveable generally along said second leg portion;

(c) clamping the first leg portion to the chain means;

(d) moving the chain means downwardly along the second leg portion to raise the second leg portion relative to the first leg portion;

(e) locking the second leg portion against downward movement relative to said first leg portion by wedging slip means, carried by the second leg portion, against the first leg portion; and (f) disengaging the clamping means from the chain means.

42. A method of manipulating apparatus for working on wells comprising the following steps:

(a) providing a mast equipped with a first leg portion and a second leg portion that is moveable longitudinally relative to the first leg portion;

(b) providing chain means arrayed generally longitudinally along the second leg portion and selectively moveble generally along said second leg portion;

(c) clamping the first leg portion to the chain means; and (d) moving the chain means upwardly along the second leg portion to lower the second leg portion relative to the first leg portion.

43. A method as defined in claim 42 further comprising the following steps:

(a) providing the mast with a pivotal mounting so that the mast may be rotated toward a generally folded configuration; and (b) rotating the mast toward the generally folded configuration.

44. A method of manipulating apparatus for working on wells comprising the following steps:

(a) providing a pivotally mounted mast that may be rotated between an erect configuration and a generally folded configuration; and (b) providing a snubber pivotally supported from the mast.

45. A method as defined in claim 44 further comprising the steps of rotating the mast toward the generally folded configuration and rotating the snubber in the opposite rotational sense to position the snubber generally under the folded mast.

46. A method as defined in claim 44 further comprising the steps of rotating the mast from the generally folded configuration to the erect configuration and rotating the snubber in the generally opposite rotational sense to position the snubber generally vertically.

47. A method of manipulating apparatus for working on wells comprising the following steps:

(a) providing a mast; and (b) providing a leg assembly collapsible generally against the mast and including a vertical portion.

48. A method as defined in claim 47 further comprising the following steps:

(a) unfolding the leg assembly to position the vertical portion displaced from the mast;

(b) raising a platform along the vertical portion of the leg assembly by a line extending from the mast to the platform; and (c) locking the platform to the vertical portion of the leg assembly at a selected height.

49. A method as defined in claim 47 further comprising the following steps:

(a) lowering a platform along the vertical portion of the leg assembly by a line extending from the mast; and (b) raising the leg assembly to folded configuration generally against the mast by a line extending from the mast.

50. A method of manipulating apparatus for working on wells comprising the following steps:

(a) providing a mast mounted on support means including a skid, on which the mast is mounted, mounted on a base and selectively moveable relative thereto; and (b) adjusting the lateral position of the mast by moving the skid relative to the base in one direction or another.

* * * * *